US005653189A

United States Patent [19]

Payne

[11] Patent Number: 5,653,189

[45] **Date of Patent: *Aug. 5, 1997**

[54] HYDROFOIL CRAFT

[75] Inventor: Peter R. Payne, Severna Park, Md.

[73] Assignee: Dynafoils, Inc., Severna Park, Md.

[ * ] Notice: The term of this patent shall not extend beyond the expiration date of Pat. No. 5,469,801.

[21] Appl. No.: 481,628

[22] Filed: Jun. 7, 1995

Related U.S. Application Data

[63] Continuation-in-part of Ser. No. 63,782, May 19, 1993, Pat. No. 5,469,801, which is a continuation-in-part of Ser. No. 810,869, Dec. 20, 1991, Pat. No. 5,311,832.

[51] Int. Cl.[6] ..... B63B 1/30

[52] U.S. Cl. ..... 114/274

[58] Field of Search ..... 114/274–282, 67 A; 440/66; 244/198, 35 R, 35 A

[56] References Cited

U.S. PATENT DOCUMENTS

| | | | |
|---|---|---|---|
| Re. 18,181 | 9/1931 | Stelzer . | |
| 796,846 | 8/1905 | De Lambert . | |
| 1,107,260 | 8/1914 | Burney . | |
| 1,222,674 | 4/1917 | Ruhe | 14/291 |
| 1,301,917 | 4/1919 | De Bolotoff . | |
| 1,752,406 | 4/1930 | Wetch . | |
| 1,818,309 | 8/1931 | De Villard | 244/35 R |
| 1,878,775 | 9/1932 | Henry . | |
| 2,214,945 | 9/1940 | Weihmiller . | |
| 2,603,179 | 7/1952 | Gardiner . | |
| 2,709,979 | 6/1955 | Bush et al. | 114/66.5 |
| 2,749,870 | 6/1956 | Vavra | 114/282 |
| 2,764,954 | 10/1956 | Oeltgen | 440/38 |
| 2,771,051 | 11/1956 | Von Schertel | 114/274 |
| 3,006,307 | 10/1961 | Johnson | 114/274 |
| 3,016,863 | 1/1962 | Johnson, Jr. | 114/66.5 |
| 3,044,432 | 7/1962 | Wennagel et al. | 114/274 |
| 3,104,642 | 9/1963 | Piazza | 114/280 |
| 3,109,495 | 11/1963 | Lang | 114/278 |
| 3,117,546 | 1/1964 | Von Schertel | 114/274 |
| 3,141,437 | 7/1964 | Bush et al. . | |
| 3,146,751 | 9/1964 | Von Schertel | 114/278 |
| 3,156,209 | 11/1964 | Ask . | |
| 3,183,871 | 5/1965 | Reder . | |
| 3,199,484 | 8/1965 | Wiberg | 114/280 |
| 3,221,698 | 12/1965 | Turner | 114/278 |
| 3,236,202 | 2/1966 | Quady et al. . | |
| 3,270,699 | 9/1966 | Bush | 114/280 |

(List continued on next page.)

FOREIGN PATENT DOCUMENTS

| | | | |
|---|---|---|---|
| 636766 | 11/1968 | Australia . | |
| 8703191 | 11/1991 | Australia . | |
| 836288 | 1/1941 | France . | |
| 1272736 | 8/1961 | France . | |
| 31295 | 1/1965 | German Dem. Rep. . | |
| 768045 | 6/1955 | Germany . | |
| 1193821 | 5/1965 | Germany . | |
| 549266 | 10/1956 | Italy . | |
| 619232 | 3/1961 | Italy . | |
| 6-56068 | 3/1994 | Japan | 114/274 |
| 150392 | 2/1984 | Norway . | |
| 458771 | 12/1936 | United Kingdom . | |
| 572413 | 10/1945 | United Kingdom . | |
| 745821 | 3/1956 | United Kingdom . | |
| 8401137 | 3/1984 | WIPO . | |

OTHER PUBLICATIONS

"Design of High–Speed Boats: Planing", Payne, Peter R., Introduction to Planing, Copyright, 1988, pp. 18, 19, 208, 209, 212, 213.

William M. Ellsworth, AIAA/SNAME Advanced Marine Vehicles Conf., AIAA/SNAME Advanced Marine Vehicles Conf., AIAA Paper #74–306, San Diego CA, 1974 Corresponds to USP 4,579,076 Corresponds to USP 5,044,432.

*Primary Examiner*—Edwin L. Swinehart
*Attorney, Agent, or Firm*—Leydig, Voit & Mayer

[57] ABSTRACT

A high-speed hydrofoil craft has a hull supported by a foil. When the foil is submerged, the upper surface of the foil may be ventilated by atmospheric air to form an air-filled cavity, in which case the foil performs similarly to a planing foil.

28 Claims, 20 Drawing Sheets

U.S. PATENT DOCUMENTS

| | | | |
|---|---|---|---|
| 3,324,815 | 6/1967 | Morales . | |
| 3,335,687 | 8/1967 | Von Schertel | 114/228 |
| 3,343,512 | 9/1967 | Rasmussen . | |
| 3,347,197 | 10/1967 | Scherer | 114/66.5 |
| 3,354,857 | 11/1967 | Hobday | 114/66.5 |
| 3,417,722 | 12/1968 | O'Neill | 114/274 |
| 3,434,447 | 3/1969 | Christensen et al. | 440/66 |
| 3,456,611 | 7/1969 | Johnson . | |
| 3,459,146 | 8/1969 | Prior | 114/274 |
| 3,498,247 | 3/1970 | Handler | 114/274 |
| 3,499,412 | 3/1970 | Anthes et al. | 440/67 |
| 3,547,063 | 12/1970 | Follett . | |
| 3,710,747 | 1/1973 | Guidi | 114/274 |
| 3,722,450 | 3/1973 | Arimura . | |
| 3,730,123 | 5/1973 | Lang | 114/66.5 |
| 3,760,756 | 9/1973 | Boden . | |
| 3,762,355 | 10/1973 | Raynes . | |
| 3,763,810 | 10/1973 | Payne . | |
| 3,797,434 | 3/1974 | Matthews . | |
| 3,812,806 | 5/1974 | Kortkov et al. . | |
| 3,885,513 | 5/1975 | Von Schertel et al. | 114/66.5 |
| 3,896,752 | 7/1975 | Von Schertel | 114/66.5 |
| 3,897,744 | 8/1975 | Lang | 114/61 |
| 3,915,106 | 10/1975 | De Witt | 114/66.5 |
| 3,949,695 | 4/1976 | Pless . | |
| 3,977,348 | 8/1976 | Bordat et al. | 114/274 |
| 4,304,558 | 12/1981 | Holtermann | 440/67 |
| 4,579,076 | 4/1986 | Chaumette | 114/275 |
| 4,606,291 | 8/1986 | Hoppe . | |
| 4,649,851 | 3/1987 | April . | |
| 4,665,853 | 5/1987 | Gerdsen et al. . | |
| 4,748,929 | 6/1988 | Payne . | |
| 4,832,570 | 5/1989 | Solia | 416/43 A |
| 4,857,026 | 8/1989 | Hull . | |
| 4,896,621 | 1/1990 | Coles . | |
| 4,926,773 | 5/1990 | Manor . | |
| 4,929,200 | 5/1990 | Guezou et al. . | |
| 4,949,919 | 8/1990 | Wajnikonis . | |
| 4,955,312 | 9/1990 | Magazzu . | |
| 5,171,175 | 12/1992 | Buzzi | 440/66 |
| 5,311,832 | 5/1994 | Payne | 114/274 |
| 5,469,801 | 11/1995 | Payne | 114/274 |

FIG. 5
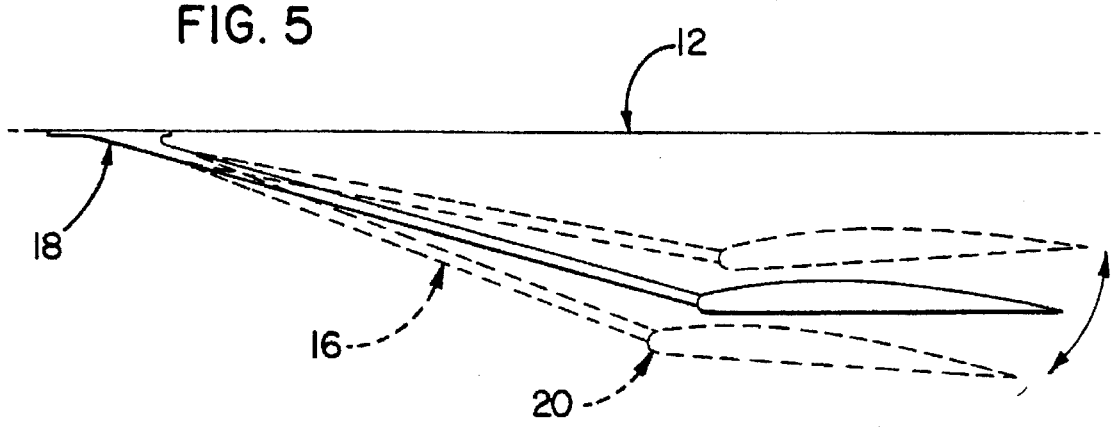
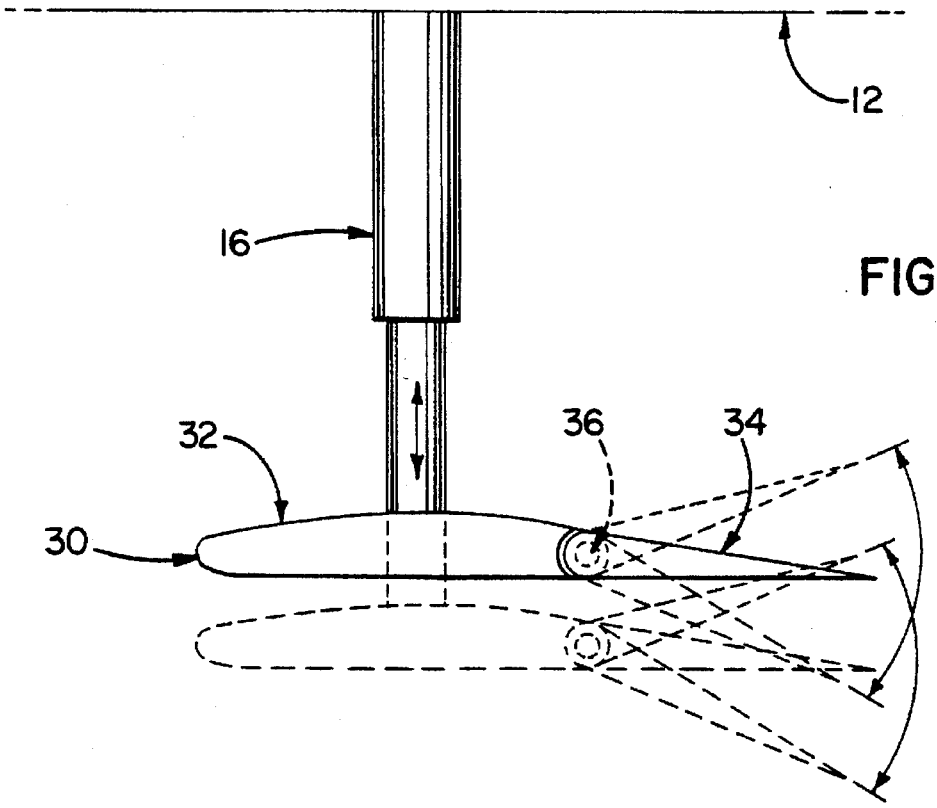
FIG. 6

FIG. 7
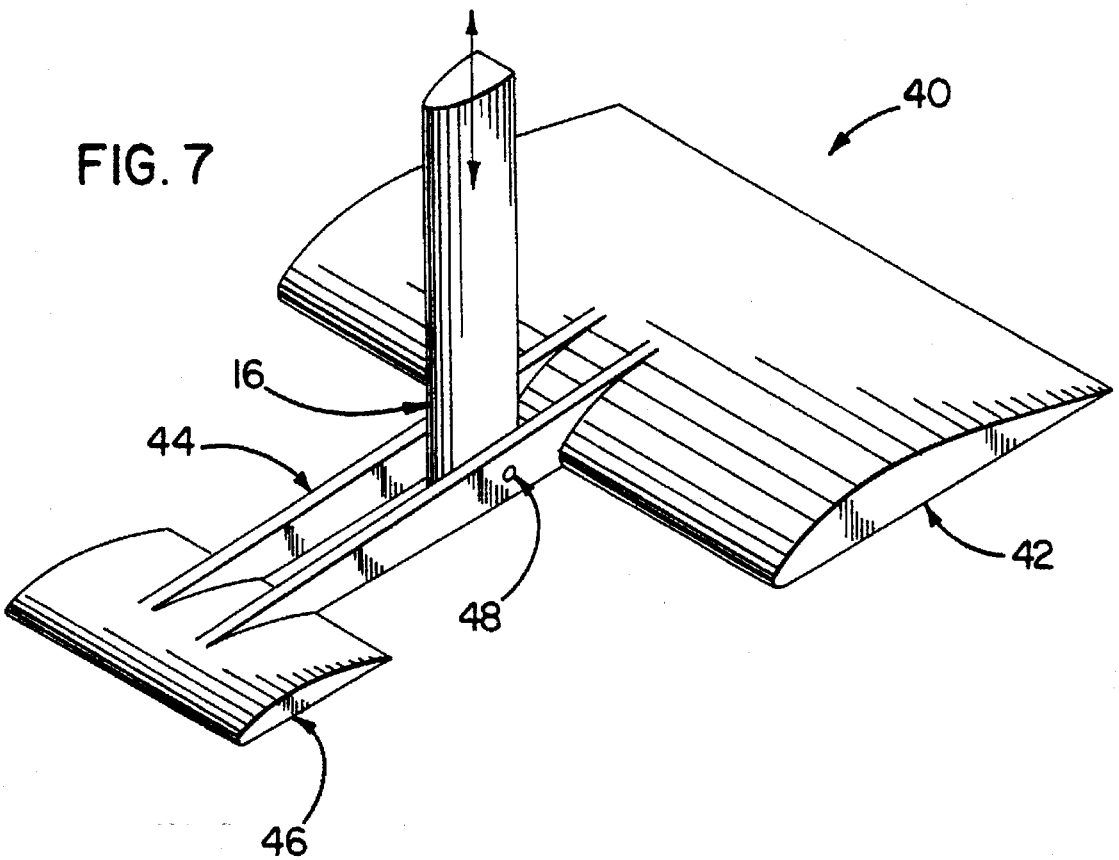
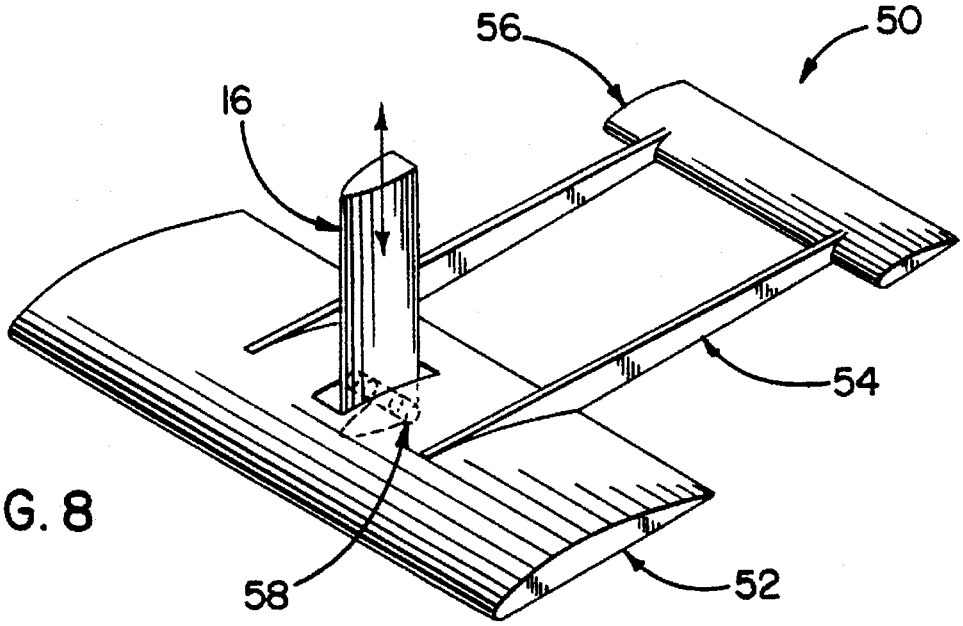
FIG. 8

FIG. 16a
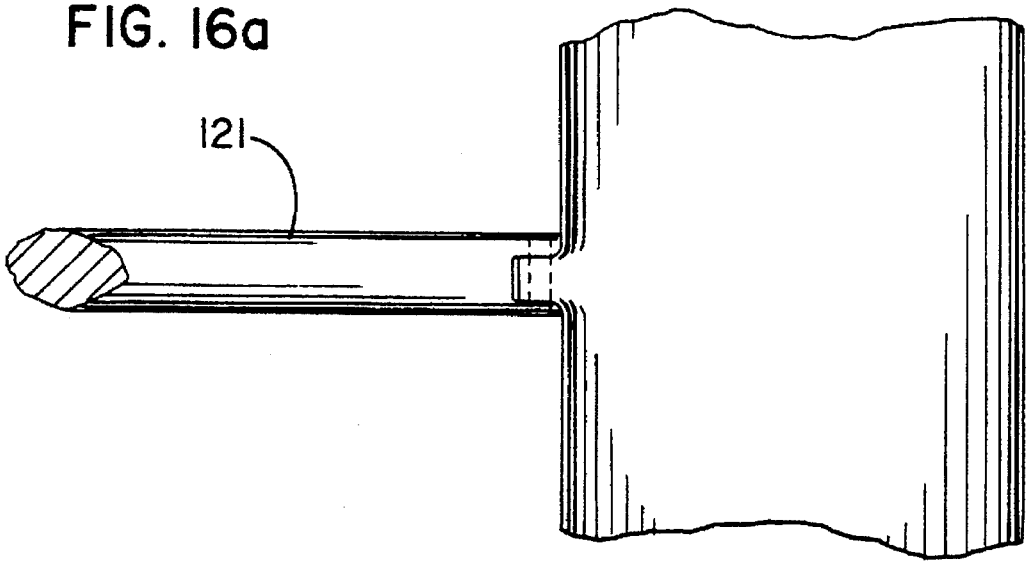
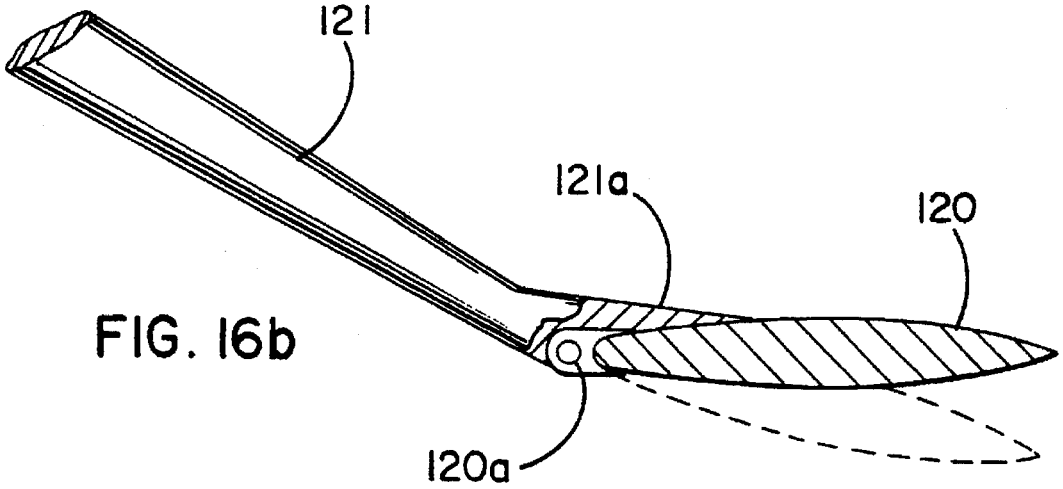
FIG. 16b
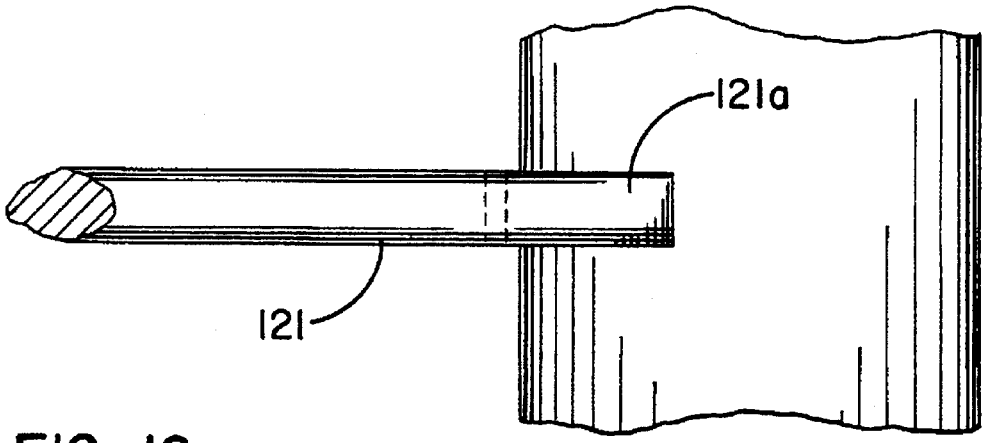
FIG. 16c

HYDROFOIL CRAFT

REFERENCE TO RELATED APPLICATIONS

This application is a continuation-in-part of application Ser. No. 08/063,782, filed on May 19, 1993, now U.S. Pat. No. 5,469,801, which is a continuation-in-part of application Ser. No. 07/810,869, filed on Dec. 20, 1991 and issued as U.S. Pat. No. 5,311,832, which is incorporated herein by reference, and of PCT/US92/10774 filed on Dec. 18, 1992.

BACKGROUND OF THE INVENTION

This invention relates to hydrofoil craft, and particularly to hydrofoil craft capable of operating at high speeds with low drag.

Hydrofoil craft are boats which typically possess a more or less conventional planing boat hull and which have one or more support arms extending from beneath the hull into the water. One or more foils for supporting the hull are connected to the lower ends of the support arms. When the hydrofoil craft has accelerated to a sufficient velocity through the water, the lift created by the foils raises the hull above the water's surface, thus eliminating the hull's resistance.

Conventional hydrofoil craft have a number of problems which make them difficult or impractical to operate at high speeds. A first problem is cavitation, which is a phenomenon in which vapor bubbles form along the upper surface of a foil due to a low fluid pressure on this surface. Cavitation invariably occurs in conventional hydrofoil craft above a certain operating speed (typically around 50 knots). When the vapor bubbles caused by cavitation collapse in the water, they produce strong shock waves. If the collapse occurs in the vicinity of the foil, the shock waves not only produce unpleasant noise and vibrations, but can also physically damage the foil of the craft by pitting.

In order to prevent damage by cavitation, foils referred to as supercavitating foils have been developed. With a supercavitating foil, a large vapor-filled cavity, referred to as a separation bubble, is formed over substantially the entire upper surface of the foil. Vapor bubbles in the cavity are carried beyond the trailing edge of the foil and collapse in the water aft of the foil, so that shock waves produced by the collapse of the bubbles have much less effect on the foil than in a normal cavitating foil.

While a supercavitating foil prevents the collapse of air bubbles in the vicinity of the foil which could damage the foil, in order to prevent the separation bubble from collapsing, it is necessary to maintain the foil at an extremely high angle of incidence. This high angle of incidence results in a great deal of drag, so that the lift/drag ratio of a conventional supercavitating foil is so low as to make such a foil impractical. For this reason, supercavitating foils are not used in practice, and hydrofoil craft must rely on conventional cavitating foils, which as described above are unsatisfactory.

Aside from the problem of cavitation, conventional hydrofoil craft have the problem that their foils invariably operate in a turbulent flow regime, so that the drag on the foils is high, and a great deal of power is required to drive a conventional hydrofoil craft at high speeds.

Another problem is that conventional hydrofoil craft have their foils connected to the hull of the craft by support arms rigidly attached to the hull. As a result, all of the accelerations imparted to the foils are also imparted to the hull. The higher the speed of the craft, the greater the vertical accelerations of the foil, and even at moderately high speeds, if the foil is rigidly connected to the hull, the accelerations imparted to the hull may far exceed those that a human passenger can comfortably withstand.

SUMMARY OF THE INVENTION

It is an object of the present invention to provide a hydrofoil craft which can be comfortably operated at high speeds in rough water without the problems caused by cavitation.

It is still another object of the present invention to provide a hydrofoil craft which can efficiently employ a supercavitating foil.

It is yet another object of the present invention to provide a hydrofoil craft which is safer both for passengers and for sealife than conventional hydrofoil craft.

A hydrofoil craft according to the present invention includes a hull, a foil for supporting the hull above a water surface, a support arm connected between the hull and the foil, and gas supplying means for supplying gas to an upper surface of the foil when the foil is submerged to form a gas-filled cavity on the upper surface having a pressure between approximately 80% and approximately 100% of atmospheric pressure. As a result of the gas-filled cavity, the occurrence of cavitation on the upper surface of the foil can be prevented, and the foil can operate with the efficiency of a planing foil. Gas may be supplied to the foil by various routes, such as along the trailing edge of the support arm or along the interior of the support arm.

BRIEF DESCRIPTION OF THE DRAWINGS

FIG. 5 is a schematic view depicting the way in which flexible support arms move in concert with the changes in water velocity around the foils.

FIG. 6 is a side elevational view depicting a foil with a hinged flap.

FIG. 7 is a perspective view depicting a canard tandem foil arrangement which is stabilized by the forward foil.

FIG. 8 is a perspective view depicting a tandem foil arrangement which is stabilized by the aft foil.

FIGS. 16*a*–16*c* are views of a main foil that can be used in the embodiment of FIG. 12.

DESCRIPTION OF PREFERRED EMBODIMENTS

Figure 1:
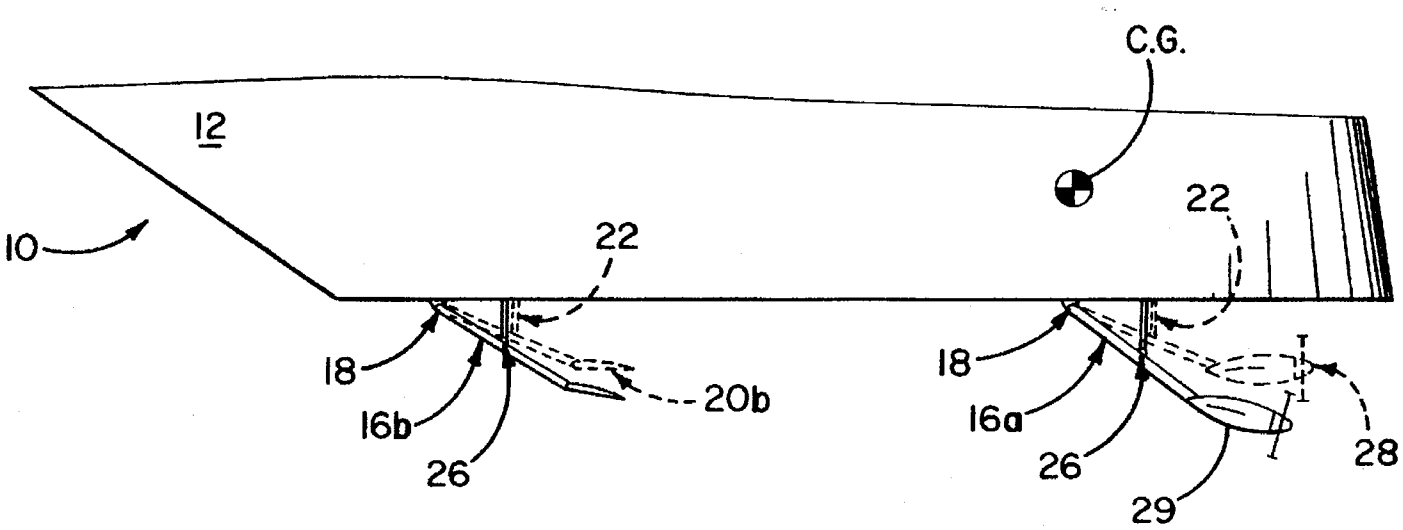
FIG. 1 is a side elevational, partially schematic view of an embodiment of a hydrofoil craft according to the present invention with means for allowing the foils to move in concert with the upgusts and downgusts of water velocity around the foils.
Figure 2:
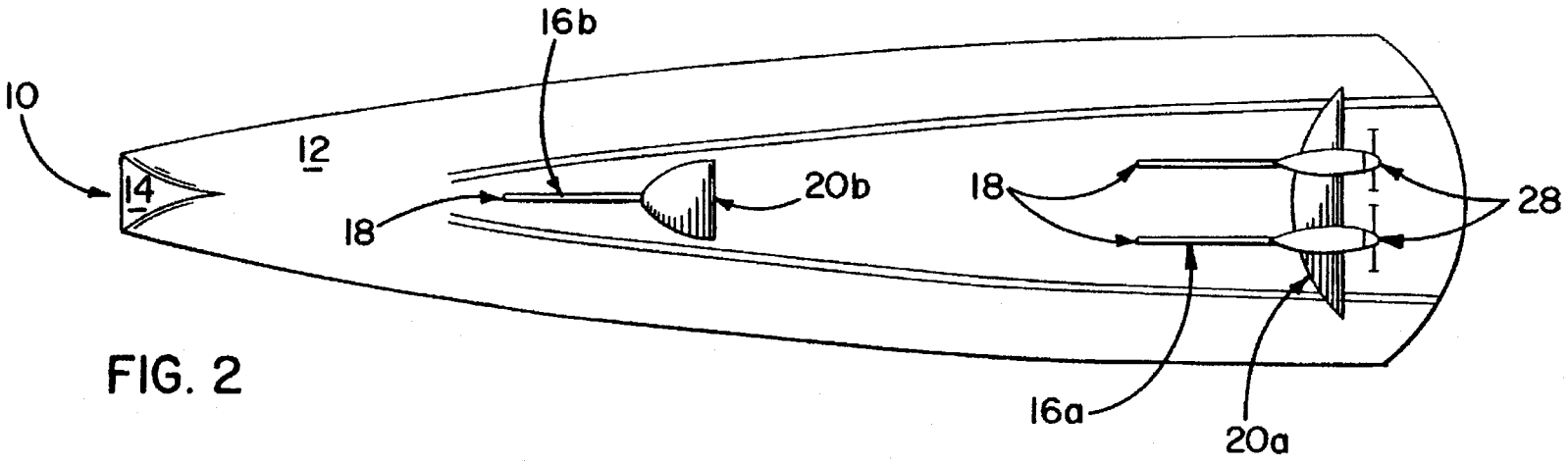
FIG. 2 is a bottom plan view of the embodiment of FIG. 1.

FIGS. 1 and 2 schematically illustrate an embodiment of a hydrofoil craft 10 according to the present invention which is capable of operating at high speeds in rough water. The hydrofoil craft 10 has at least one hull 12 of a desired configuration. Preferably, the hull 12 possesses a configuration which enables the hull 12 to cut through the higher waves of a rough sea without experiencing large accelerations. An example of such a hull configuration is disclosed in U.S. Pat. No. 3,763,810, which is incorporated by reference. The hull's slender configuration reduces the dynamic lift of the hull 12 when in contact with the water. Accordingly, the reduced plan area of the forward sections of the hull 12 minimizes dynamic lift forces during wave impacts, thus reducing both drag and vertical acceleration. A transom 14 can be incorporated in the bow of the hull 12. The bow transom 14 helps to prevent complete bow submergence during severe wave impacts.

Figure 3:
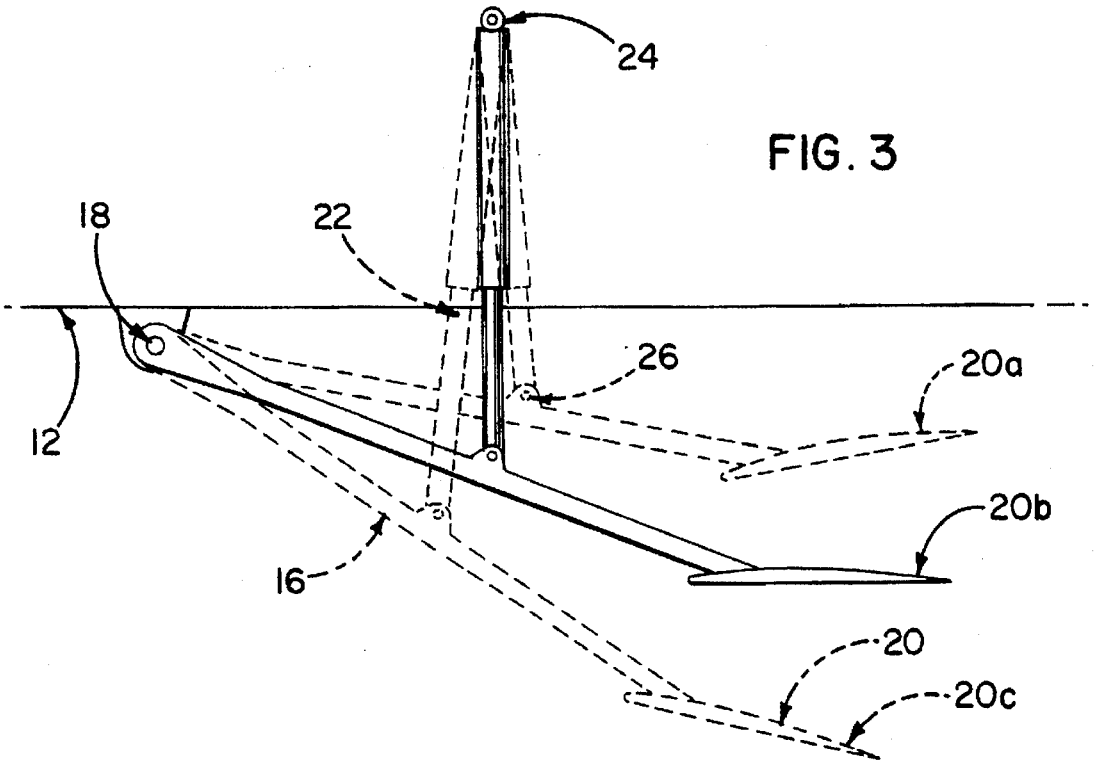
FIG. 3 is a schematic view illustrating the way in which support arms which extend angularly downward from the hull of the hydrofoil craft move in concert with the upgusts and downgusts of water velocity around the foils.
Figure 4:
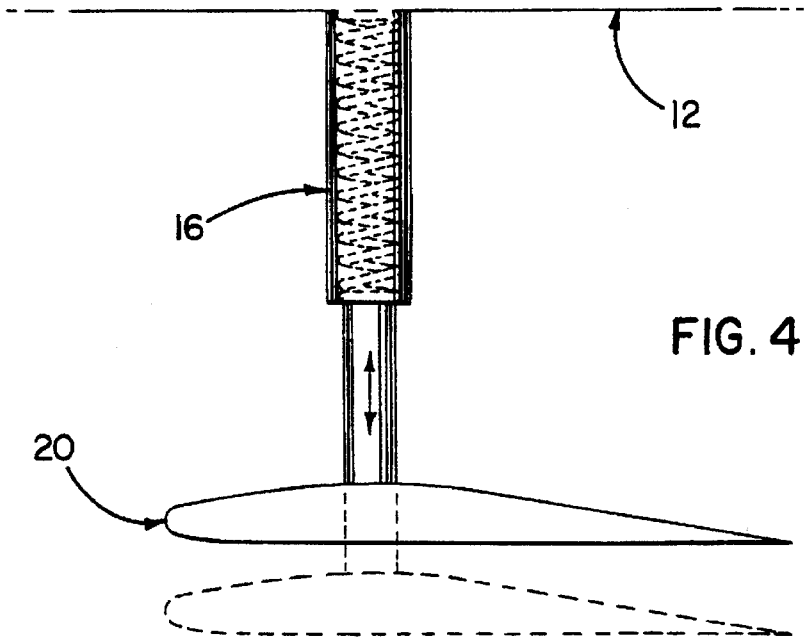
FIG. 4 is a schematic view showing the way in which support arms which extend vertically downward move in concert with the changes in water velocity around the foils.

In the present invention, at least one support arm 16 is attached to the hull 12, preferably at or near the bottom. The support arms 16 are attached so that they extend downward from the plane of the bottom of the hull 12 into the water. Preferably, the support arms 16 extend angularly downward from the hull 12 into the water, as is shown in FIG. 3. However, the support arms 16 can also extend vertically downward from the hull 12 into the water, as is shown in FIG. 4, the vertical motion being obtained by a telescoping mechanism. Preferably, at least two support arms 16 are attached to the hull 12, with one support arm 16 located toward the rear of the hull 12 and another support arm 16 located toward the forward portion of the hull 12.

Each support arm 16 is attached at or near the bottom of the hull 12 at an attachment or connection 18. Attachment of each support arm 16 at or near the bottom of the hull 12 can be either pivotal or rigid. Where the attachment or connection 18 is rigid, each support arm 16 can be at least partially flexible. That is, each support arm 16 can be either uniformly flexible so that the support arm 16 bends throughout its entire length or only partially flexible (e.g., the support arm 16 can be rigid except near the attachment or connection 18 where the support arms 16 are thinner so as to allow the support arm 16 to bend only at this thin section), as is shown in FIG. 5. These flexible support arms can be made of any resilient material, such as fiberglass or steel.

Figure 11:
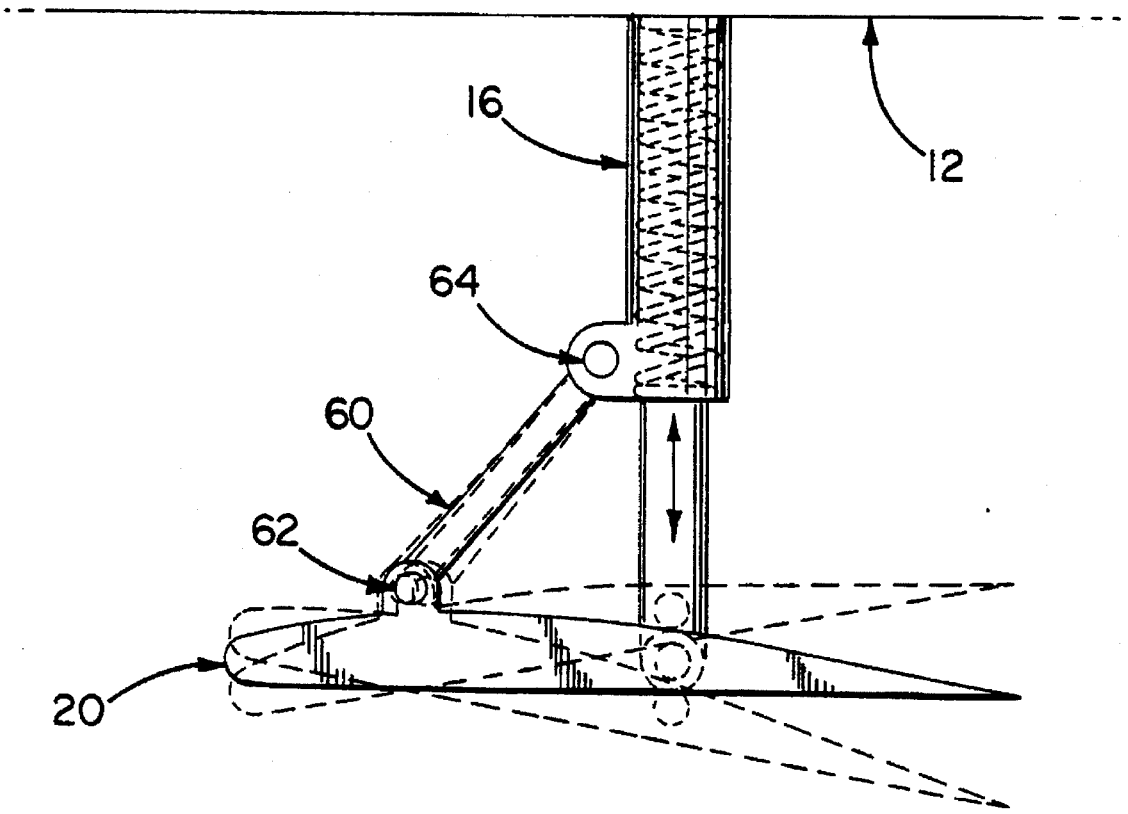
FIG. 11 is a side elevational view showing the way in which the angle of incidence at which foils, which are attached to support arms which extend vertically downward from the hull of the hydrofoil craft, encounter approaching water can be adjusted through the use of a shock strut.

Furthermore, where the attachment or connection 18 is rigid and each support arm 16 is not at least partially flexible, each support arm 16 can extend vertically downward from the hull 12 of the hydrofoil craft 10 and can be telescoping in nature, as is shown in FIGS. 6 and 11. These telescoping support arms 16 are cylinders which move up and down in response to the changes in local water velocity around the foils 20. The telescoping nature of these support arms 16 allows the foils 20 to move in concert with the local changes in water velocity while allowing the hull 12 of the hydrofoil craft 10 to track a path of approximately constant elevation above the water.

In contrast, where the attachment or connection 18 is pivotal, each support arm 16 is preferably rigid, although each support arm 16 can be at least partially flexible in the manner previously described. Furthermore, the pivotal attachment can be by any means known in the art.

Each support arm 16 is also attached to a foil 20. In embodiments where two support arms 16 are attached to the hull 12, it is preferable to have a main foil **20*a*, which provides most of the hull's support while foil-borne, attached to the support arm 16 located near the longitudinal center of gravity of the hull 12, while a smaller foil 20*b* is attached to the support arm 16 located under a forward or aft position of the hull 12**.

As is illustrated in FIG. 3, foil 20 is located near the water's surface during the operation of the hydrofoil craft 10. The foil 20 creates the lift necessary to elevate the hull 12 of the boat above the water's surface. As is well-known in the art, foils create the necessary lift through the angle of incidence at which the foils encounter the approaching water.

According to the present invention, the foils 20 can create the lift necessary to elevate the hull 12 of the hydrofoil craft 10 above the water's surface by having the angle of incidence at which the foils 20 encounter the approaching water adjusted in a number of ways including, but not limited to, employing a foil 30 with a hinged flap, or a tandem foil 40 or 50. FIG. 6 depicts a foil 30 with a hinged flap. The foil 30 has a main portion 32 of the foil 30 rigidly attached to the support arm 16. A rear flap 34 is pivotally attached to the main portion 32 of the foil 30 by any means known in the art, preferably a hinge, at a pivotal attachment or connection site 36.

When the foil 30 encounters an upgust or downgust of vertical water velocity, the rear flap 34 pivots and changes its orientation so that the effective angle of incidence at which the foil 30 encounters the approaching water is adjusted.

FIG. 7 depicts a tandem foil arrangement 40 which is stabilized by the forward foil 46. The tandem foil arrangement 40 has an aft foil 42 which is attached to a connecting structure 44 and a forward foil 46 which is also attached to the connecting structure 44. The tandem foil arrangement 40 is pivotally attached to the support arm 16 by any means known in the art, preferably by a pitch hinge, at a pivotal attachment or connection site 48. When the tandem foil arrangement 40 encounters a change in vertical water velocity, the angle at which the forward foil 46 attacks the approaching water is greater than the angle at which the aft foil 42 attacks the approaching water, the result of which being that the lift created by the forward foil 46 returns the tandem foil arrangement 40 to its original angle of incidence to the new relative water flow direction.

FIG. 8 depicts a tandem foil arrangement 50 which is stabilized by the aft foil 56. The tandem foil arrangement 50 has a forward foil 52 which is pivotally attached to the support arm 16 at an attachment or connection site 58 by any means known in the art, preferably a pitch hinge. The forward foil 52 is attached to a connecting structure 54 which, in turn, is attached to an aft foil 56. This aft foil 56 acts in the same way as the forward foil 46 of the tandem foil arrangement 40 acts; that is, when the tandem foil arrangement 50 encounters a change in vertical water velocity, the lift created by the aft foil 56 restores the tandem foil arrangement 50 to its original angle of incidence with respect to the new relative water flow direction.

When the hull 12 has a very slender configuration, the foils 20 are preferably smaller than the foils typically found on conventional hydrofoil craft. These smaller foils can be used in combination with the slender hull because the slender hull can remain in nominal contact with the water before higher speed before "takeoff" than is possible with conventional hulls. This phenomenon increases the cruise efficiency of the hydrofoil craft because the foils can be smaller.

According to one aspect of the present invention, support arms 16 which extend angularly downward from the hull 12 into the water and which are not at least partially flexible are held in a downward, angular position by shock struts 22 which are connected to the support arms 16 by pivotal connection 26 and connected at or near the bottom of the hull 12 by pivotal attachment or connection 24 through any means known in the art, as is shown in FIG. 1. These shock struts 22 provide means which allow the support arms 16 and the foils 20 to move in concert with the changes in water velocity around the foils 20. Suitable shock struts 22 include, but are not limited to, mechanical compression springs, hydraulic cylinders, and pneumatic cylinders. Where cylinders are used as shock struts 22, accumulators are typically used in concert with the cylinders to reduce the spring rate or change its characteristics, as is well-known in the art.

As is depicted in FIG. 3, the shock struts 22 allow the support arms 16, and thus the foils 20, to move in concert with the changes in vertical water velocity (upgusts and downgusts) in waves located around the foils. If the water velocity around the foil 20 is locally going down (downgusts), the foil's lift is reduced and the shock struts 22 force the foil 20 to move in concert with the water and go down with it almost instantly to the lower position shown by dashed lines. On the other hand, where the water velocity is locally going up (upgust), the foil's lift is increased and the shock strut 22 allows the foil 20 to go up with it almost instantly to the upper position shown by dashed lines. Thus, the shock struts 22 allow the foils 20 to move almost instantaneously in response to these local upgusts and downgusts of water velocity. Because the support arms 16 are pivotably and not rigidly attached to the hull 12, this instantaneous foil movement does not affect the movement of the hull 12 of the boat, and the foils 20 move independently of the hull 12 of the boat. Accordingly, this support arm 16/shock strut 22/foil 20 construction allows the hull 12 of the boat to track a path of approximately constant elevation above the water's surface while the foils 20 move in concert with the local upgusts or downgusts of water velocity, thus affording the hull 12 of the boat a smooth ride in rough waters.

Figure 9:
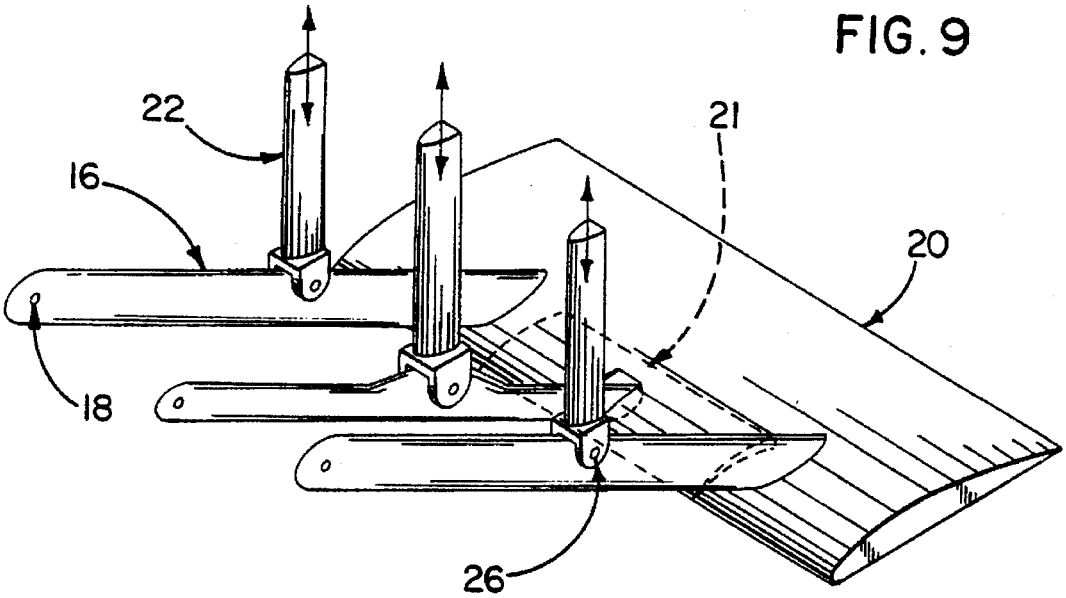
FIG. 9 is a perspective view showing both foils of a dual foil system, which can be used to reduce foil resistance at high speeds, both in a downward position.
Figure 10:
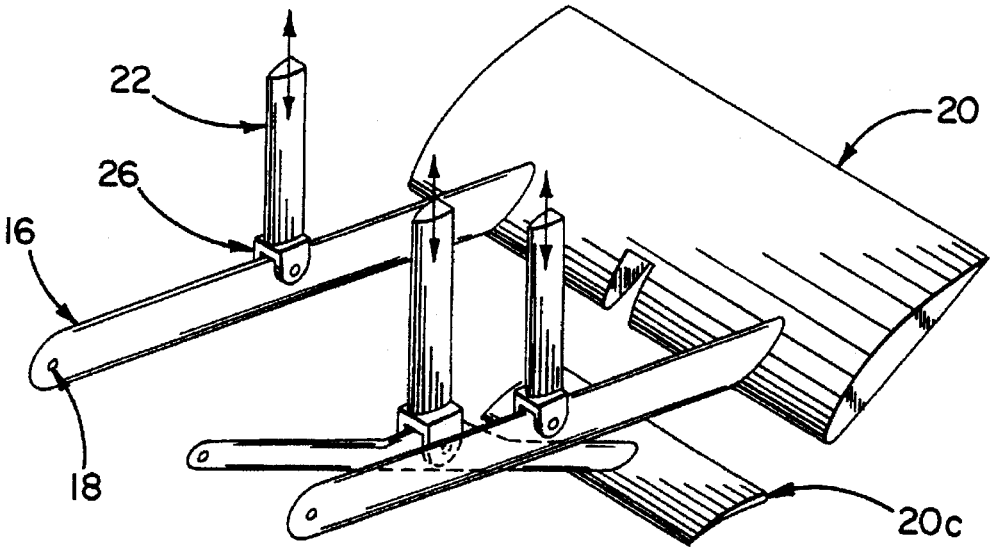
FIG. 10 is a perspective view depicting a dual foil system which can be used to reduce foil resistance in the water by lifting one of the foils out of the water.

Furthermore, the support arm 16/shock strut 22/foil 20 system permits another way in which the size of the main foil 20*a* may be reduced at high speeds, thus reducing the resistance of the hydrofoil craft 10 at high speeds. As is shown in FIG. 9, two "main foils" can be down in the water at low speeds: one large foil 20 for low speed operation and a small foil 20(*c*) for high speed operation. At low speeds these foils can be nested together or they can be in tandem. On reaching a high enough speed for the small foil 20(*c*) to be able to support the weight of the craft 10 by itself, the large foil 20 is lifted out of the water so that it rests against or close to the bottom of the hull 12 by retracting the shock struts 22 which were previously holding it down, as is shown in FIG. 10. Preferably, the large foil 20 is hinged near its leading edge with respect to its support arm[s] so that the foil 20 points into the relative water flow when retracted. All of the weight of the hull 12 is then carried by the shock strut 22 which holds down the support arm 16 which is attached to the smaller foil 20(*c*).

In addition to greatly reducing the resistance of the craft 10 at high speeds, this method permits different types of foil to be employed at low and high speeds. The low speed foil would typically have a sectional shape similar to that of an airplane wing, with a rounded leading edge, known as a "subcavitating foil", which can efficiently develop high lift coefficients. The small foil 20(*c*) for high speeds, on the other hand, would typically be of the supercavitating type, designed to operate with an air-filled cavity above its upper surface.

The support arm 16 which is attached to the large foil 20 preferably has conventional streamline sections, e.g., the support arm 16 possesses leading and trailing edges which are more narrow relative to the center of the support arm 16, so that atmospheric air cannot find its way down the support arm 16 to vent the upper surface of the foil 20 and thus reduce its lift. The support arm 16 which is attached to the small foil 20(*c*), on the other hand, preferably has blunt trailing edges to provide an easy path down the support arm 16 for atmospheric air to ventilate the upper surface of the small foil 20(*c*).

According to the present invention, the angle of incidence at which the foils 20 contact the approaching water is adjusted automatically so as to minimize a reduction in lift when the foils 20 encounter a downgust or minimize an increase in lift when the foils 20 encounter an upgust. This automatic adjustment can be accomplished by any means known in the art or previously discussed herein.

Preferably, the angle of incidence at which the approaching water contacts the foil 20 is adjusted by the same means which adjusts the movement of the foil 20. Namely, the angle of incidence is adjusted by the support arm 16/shock strut 22/foil 20 system. This simultaneous adjustment of both the angle of incidence at which the foil 20 attacks the approaching water and the position of the foil 20 in the water by moving the support arms 17 in concert with the changes in vertical water velocity in waves located around the foil 20 is effected by the foil 20 being rigidly connected to the support arms 16. Thus, when the hydrofoil craft 10 encounters a downgust, the foil 20 goes down with the water and, because the foil is rigidly connected to the support arms, the angle of incidence at which the foil 20 contacts the water is necessarily adjusted so as to minimize a reduction in lift. Conversely, when the hydrofoil craft 10 encounters an upgust, the foil 20 goes up with the water and the angle of incidence at which the foil 20 contacts the approaching water is automatically adjusted so as to minimize an increase in lift. This system allows not only the foil's location in the water but also the angle of incidence at which the foil contacts approaching water to be adjusted instantaneously, thus affording the hull 12 of the boat a smooth ride in rough water. Accordingly, in preferred embodiments no foil-mounted control mechanisms are necessary.

According to one aspect of the present invention, the foil 20 in the support arm 16/shock strut 22/foil 20 system can be a foil 30 with a hinged flap. Preferably, the hinge line is close to the leading edge of the foil 30. Using a foil 30 with a hinged flap in this position results in the hinged flap "feathering" into the relative water flow when it encounters a downgust of vertical water velocity and being held against a stop when it encounters an upgust of vertical water velocity, thus minimizing the resistance of the foil 20 when it is in a retracted position.

According to another aspect of the present invention, support arms 16 which extend angularly downward from the hull 12 into the water and which are at least partially flexible are held in a downward, angular position by an attachment or connection 18 which is rigid. The flexible nature of the support arms 16 allows the support arms 16 to bend in response to the changes in water velocity around the foils 20 almost instantaneously and thus to move in concert with the local upgusts or downgusts of water velocity. Because the flexible support arms bend in response to the changes in vertical water velocity around the foils 20, the instantaneous movement does not affect the movement of the hull of the boat, thus affording the hull 12 of the craft a smooth ride. Moreover, the same mechanism which adjusts the location of the foil 20 in the water preferably adjusts the angle of incidence at which the foil 20 attacks the approaching water. As is previously described, the angle of incidence at which the foils 20 contact the approaching water is preferably adjusted by rigidly attaching the foils 20 to the flexible support arms so that the angle of incidence at which the foils 20 contact the approaching water is adjusted by the same means which adjusts the movement of the foils 20, although any means of adjusting the angle of incidence which has been previously discussed or which is well-known in the art can be used.

According to yet another aspect of the present invention, telescoping support arms 16 which are not at least partially flexible and which extend vertically downward from the plane of the bottom of the hull 12 into the water can be used. The telescoping nature of these support arms 16 allows the foils 20 to move in concert with the changes in vertical water velocity around the foils, as is depicted in FIG. 11, and thus affords the hull 12 of the craft 10 a smooth ride. Again, it is preferred that the same mechanism which adjusts the position of the foil 20 in the water also adjusts the angle of incidence at which the foil 20 attacks the approaching water. Although any means of adjusting the angle of incidence which has been previously discussed or which is well-known in the art can be used, preferably, the angle of incidence at which the foils 20 contact the approaching water is adjusted by pivotally attaching a hinged link 60 to the foil 20 and the support arm 16 at pivotal attachment or connection sites 62 and 64, respectively. When the foil 20 encounters a change in vertical water velocity, the foil 20 moves in concert with the water due to the telescoping nature of the support arm 16 and the angle of incidence at which the foil 20 encounters approaching water is automatically adjusted due to the hinged link 60 changing the position of the foil 20 upon movement of the support arm 16, as is shown in FIG. 11.

Another advantage which the hydrofoil craft 10 of the present invention possesses is that the hydrofoil craft 10 can use supercavitating foils because it has the ability to move its foils 20 up and down in concert with the changes in vertical water or air velocity located around the foils 20. A supercavitating foil is a foil which at high speeds does not have any water flow contacting the upper surface of the foil, thus creating a cavity above the foil. At high speeds in calm water, this cavity contains only water vapor at very low pressure. If a supercavitating foil is at a low enough angle of incidence for efficient (low drag) operation, the vapor-filled cavity is unstable and the forces on the foil vary randomly and violently. If such a foil gets too close to the surface of the water, the low pressure of the vapor cavity can suck in atmospheric air causing the foil's lift to fall to about one-third of its supercavitating value. See, Conolly, Alan, "Prospects For Very High Speed Hydrofoils," Marine Technology, Volume 12, No. 4, pp. 367–377 (1975). It is believed that because of this sudden decrease in lift when a supercavitating foil gets too close to the water's surface, such supercavitating foils are not in practical use today. However, such supercavitating foils can be employed on the hydrofoil craft 10 of the present invention because the rapid changes in lift caused by the instability of the cavity merely causes the support arms 16 attached to the craft 10 to move up and down appropriately so as to reduce or to increase the angle of incidence of the foils 20 so as to maintain lift, thus assuring the hull 12 of the craft 10 a smooth ride.

Furthermore, where the support arms 16 extend angularly downward from the hull 12 of the craft 10 into the water, the resistance of such supercavitating foils, for a given lift, is minimized by the fact that atmospheric air is continuously available to the cavity above the foil due to the angle at which the support arms 16 are inclined. Having the support arms 16 inclined at an angle to the vertical, as is depicted in FIG. 3, results in a significant decrease in the amount of drag and, therefore, resistance which is due to the dynamic pressure of the water contacting the support arms 16. For example, when the support arms are disposed at an angle of 60° with respect to the vertical (a typical value), cos 30°=0.5 and, therefore, the ratio $$\frac{\text{inclined support arm drag}}{\text{vertical support arm drag}}$$

(which is approximately equal to $\cos^2$ of the angle with respect to the vertical) is approximately 0.25. Thus, the pressure drag which results from the water contacting a support arm 16 which extends angularly downward is only 0.25 or 25% of the pressure drag which results from a vertical support arm contacting water. Accordingly, a support arm 16 which extends angularly downward from the hull 12 can be four times as wide as a vertical support arm while being subject to an equivalent amount of drag, and the cross-sectional area of the cavity behind the support arm 16 which extends angularly downward can be sixteen times as great as the cavity behind a vertical support arm, thus permitting sixteen times as much air to flow down behind the inclined support arm.

Furthermore, in the present invention, the foil 20 can be attached to the inclined support arm 16 by or near to its leading edge. Therefore, the atmospheric air traveling down the back of the inclined support arm 16 does not need to force its way against the water flow because it is already upstream of the cavity which it must feed. Furthermore, if no cavity already exists above the foil, this atmospheric air traveling down the back of the support arm will allow one to form as soon as it reaches the leading edge of the foil.

In preferred embodiments, the resiliency and damping characteristics of the shock strut 22/support arm 16/foil 20 system can be instantly changed, at the flip of a switch, from the wheelhouse of the hydrofoil craft 10. Changing these characteristics allows the hull 12 of the boat to obtain the optimum ride comfort in varying sea conditions. The manner in which the characteristics of the shock strut 22/support arm 16/foil 20 system can be changed depends upon the particular embodiment of this system.

For example, where the shock strut 22 is a hydraulic cylinder, the pressure of the gas in the accumulator which is connected to the hydraulic cylinder can be decreased to soften the ride or increased to stiffen the ride, depending on the condition of the sea. This adjustment can easily be controlled from the wheelhouse of the hydrofoil craft 10.

Also in preferred embodiments, the shock strut 22/support arm 16/foil 20 system can be controlled from the wheelhouse such that this system, at the flip of a switch, can be stored close to the hull 12 of the craft so that the foils 20 fit snugly against the bottom of the hull 12. When the foils 20 are stored snugly against the hull 12, the hydrofoil craft 10 can operate with reduced draft at low speeds.

According to the present invention, propeller assemblies 28 can be mounted anywhere on the hydrofoil craft 10. Preferably, the propeller assembly 28 is mounted on or behind at least one foil 20 and, more preferably, the propeller assembly 28 is mounted on the main foil 20*a* because it is the only part of the hydrofoil craft 10 which is in unequivocal water contact nearly all of the time. However, this is more costly than a conventional propeller installation and, therefore, may not always be economically desirable.

The propeller assembly 28 can include at least one propeller attached to the output member of a hydraulic motor which is mounted in a pod located on or behind the foil 20. The hydraulic motor and thus the propeller are drive by pressurized fluid from a hydraulic pump mounted on the engine of the hydrofoil craft 10. Two hydraulic lines which are attached at one end to the hydraulic motor and at the other end to the hydraulic pump carry the pressurized fluid back and forth between the hydraulic motor and the hydraulic pump. The hydraulic lines either must be flexible or incorporate a mechanical hinged joint so as to allow the foil to which the pod and hydraulic motor are attached to move in concert with the changes in water velocity around the foils.

Preferably, the hydraulic pump which is mounted on the engine of the hydrofoil craft 10 is a variable displacement pump. The variable displacement pump pressurizes the hydraulic fluid at a constant power level, so that if the flow is reduced because the motor is slowed by a greater torque load on the propeller, the fluid pressure increases. Ideally, halving the flow rate doubles the pressure. Thus, at low boat speeds, where the propeller torque is high and the motor is turning slowly, the fluid pressure is also high, maximizing the torque available in the motor. The overall effect is that of a variable gear ratio between the engine and the propeller.

In other embodiments, the propeller assembly 28 can include at least one propeller attached to the output member of an electric motor which is mounted in a pod located on the foil 20. Any device known in the art for transporting electric current through a rotating joint may be used to transport electric current produced by generators mounted on the engines of the hydrofoil craft 10 to the electric motor so as to drive the electric motor and thus the propeller. Preferably, either flexible wires or hinged commutators transport the electric current so as to allow the foil, which can be attached to the pod, to move in concert with the changes in water velocity around the foils 20.

Finally, the propeller assembly 28 can include at least one propeller attached to a mechanical transmission means. Where the propeller is mounted on a foil 20, the mechanical torque needed to drive the propeller is transmitted from the engine to the propeller through input (from the engine) and output (to the foil) shafts which are connected by a joint or linkage which can accommodate the up and down movement of the foil 20 so that the foil 20 can move in concert with the changes in vertical water velocity located around the foil 20. For example, a Hooke's joint, constant velocity joint, or a flexible rubber coupling which is coincident with the hinge axis center line of the foil 20/support arm 16 hinges can be used to connect the input and output shafts. Preferably, a gear box which allows the output shaft to swivel about a horizontal axis which is coincident with the foil 20/support arm 16 hinge center line is used. An example is a gear box which has two beveled gears facing each other and which is orthogonal to the water's surface. Driving pinions interact with and engage the beveled gears. One driving pinion is attached to a shaft which, in turn, is attached to the engine of the hydrofoil craft. This driving pinion allows the mechanical transmission of energy from the engine of the hydrofoil craft to the gear box. The other driving pinion is attached to a shaft which extends from the beveled gear box to a lower gear box located near the propeller. This shaft allows the mechanical transmission of energy from the beveled gear box to the lower gear box. Where the shaft from the upper gear box is at an angle of 30° to the water's surface so that it enters the lower gear box at this angle, the lower gear box has an output shaft which is roughly longitudinal, or parallel to the water's surface. Thus, in this example, the angle between the input and output shafts of the lower gear box is also 30°. The output shaft from the lower gear box, in turn, is attached to at least one propeller located on the foil 20.

FIGS. 12–17 illustrate another embodiment of a hydrofoil craft according to the present invention. In this embodiment, a hull 110 is supported above the water by a main foil 120 and by smaller auxiliary foils 130 located at the stern of the hull 110. At operating speed, the hull 110 is primarily supported by the lift generated by the main foil 120 and is stabilized in pitch by the auxiliary foils 130. For example, the main foil 120 may support over 95% of the weight of the hull 110, with the remainder of the weight supported by the auxiliary foils 130. The main foil 120 is rigidly connected to a pair of rigid support arms 121 which are pivotably connected to the hull 110 near their upper ends for pivoting about a transverse axis 122 extending substantially perpendicular to the centerline plane of the hull 110. The main foil 120 is shown extending substantially perpendicular to the centerline plane of the hull 110, although it can be at a different angle, such as sloping upwards. Furthermore, it can be connected to the hull 110 by a different number of support arms 121. The upper end of at least one of the support arms 121 extends into the hull 110 and is connected to a shock strut 123 or similar member which exerts a downwards biasing force on the support arms 121 to prevent their collapsing against the hull 110 under the weight of the hull 110 while enabling the support arms 121 to pivot about the transverse axis 122 so that the main foil 120 can move up and down in concert with upgusts and downgusts of water surrounding the main foil 120. The shock strut 123 can be, for example, a mechanical, pneumatic, or hydraulic shock strut like those used in the previous embodiments. If the shock strut 123 is hydraulic, it can be used not only to permit pivoting motion of the support arms 121 about the transverse axis 122 in response to upgusts and downgusts, but it can also be used to move the support arms 121 between a retracted position and a lowered position. The shock strut 123 is preferably capable of permitting vertical movement of the foil 120 in response to upgusts and downgusts by approximately the height of the largest waves (measured from trough to crest) in which the boat is intended to operate. For example, if the boat is intended to operate in three-foot waves, the shock strut 123 preferably permits the foil 120 to move upwards and downwards by approximately three feet (approximately 1.5 feet upwards and 1.5 feet downwards from its mean position in calm water). Although it is not necessary for the shock strut 123 to be disposed inside the hull 110, this arrangement has the advantage that it produces less drag than when the shock strut 123 extends into the water. In the present embodiment, the force exerted by the shock strut 123 on the support arms 121 can be adjusted by a control unit 125 (shown in FIG. 13) mounted in the hull 110 and connected to the shock strut 123.

There are no strict limits on the range of variation of the biasing force exerted by the shock strut 123 as the support arms 121 are displaced from their mean calm water position. If the biasing force is given an arbitrary value of 1.0 when the main foil 120 is at its mean distance from the hull 110 in calm water, then an example of a suitable range of variation of the biasing force is a value of at least approximately 0.5 when the foil 120 reaches the bottom of its downward movement in response to a downgust and a value of at most approximately 2.0 when the foil 120 reaches the top of its upward movement in response to an upgust. An example of a more preferred range is a value of at least approximately 0.8 when the foil 120 reaches the bottom of its downward movement and a value of at most approximately 1.4 when the foil 120 reaches the top of its upward movement. The stiffer the support provided by the shock strut 123, the less comfortable is the ride of the hydrofoil craft in rough water and the closer its behavior comes to that of a hydrofoil craft with fixed support arms.

The above-described preferred and more preferred ranges on the biasing force exerted by the shock strut are also applicable to the shock struts used in the previous embodiments. Furthermore, in the case where the support arms are flexible members and resist upward forces acting on the foil by their resilience, the downward biasing force exerted by the flexible support arms preferably is from at least approximately 0.5 to at most approximately 2 and more preferably from at least approximately 0.8 to at most approximately 1.4 as the foil moves between its lowest and highest positions with respect to the hull in response to downgusts and upgusts, taking the biasing force as 1.0 when the foil is at its mean distance from the hull in calm water.

The hydrofoil craft is steered by means of a pair of rudders 131 mounted on the stern of the hull 110 for pivoting about substantially vertical axes. The auxiliary foils 130 are secured to the lower ends of the rudders 131. The auxiliary foils 130 are shown as extending from only one side of each rudder 131 towards the centerline of the hydrofoil craft, but many other shapes are possible, such as a swept shape in which each auxiliary foil 130 extends from both sides of the corresponding rudder 131. The angle of each rudder 131 with respect to the centerline of the hull 110 can be adjusted by means of suitable actuators 132, such as hydraulic pistons or electric motors connected to the rudders 131 and controlled by the control unit 125, which rotate the rudders 131 about the substantially vertical axes. In the present embodiment, each of the rudders 131 is pivotably mounted on a support plate 133 which is connected at its upper end to the stern of the hull 110 by hinges 134 so that the support plate can pivot about a horizontal axis extending substantially perpendicular to the centerline of the hull 110. Each support plate 133 can be pivoted about its hinges 134 by an actuator 135 supported by the hull 110 and controlled by the control unit 125. Operation of the actuators 135 adjusts the angle of the longitudinal axes of the rudders 131 with respect to the vertical and accordingly adjusts the angle of incidence of the auxiliary foils 130. For example, if the rudders 131 are inclined backwards by five degrees by operation of actuators 135, the angle of incidence of the auxiliary foils 130 is reduced by five degrees, resulting in a larger downward-acting force being developed upon them, which raises the bow of the boat. Conversely, retracting the cylinders 135 will incline the rudders 131 forward, increasing the angle of incidence of the auxiliary foils 130 and raising the stern of the boat.

Preferably, each of the actuators 132 and 135 can be independently controlled. If the rudders 131 are differentially inclined, one forward and the other backwards, the lift on the former will be increased and the lift on the latter will be reduced, thus applying a rolling moment to roll the boat toward the side on which the auxiliary foil lift was reduced. When this is done at the same time as actuators 132 are used to steer the rudders 131, the boat will both turn and bank in the direction of the turn.

Instead of having a separate actuator 132 for each rudder 131, the rudders 131 may be mechanically coupled with each other by a suitable linkage and made to simultaneously rotate about the respective substantially vertical axes by a single actuator 132 connected to the linkage or to one of the rudders 131.

Figure 15:
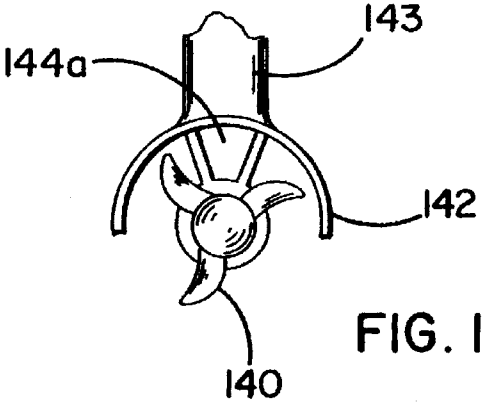
FIG. 15 is a rear elevation of the propeller of the embodiment of FIG. 12.
Figure 14:
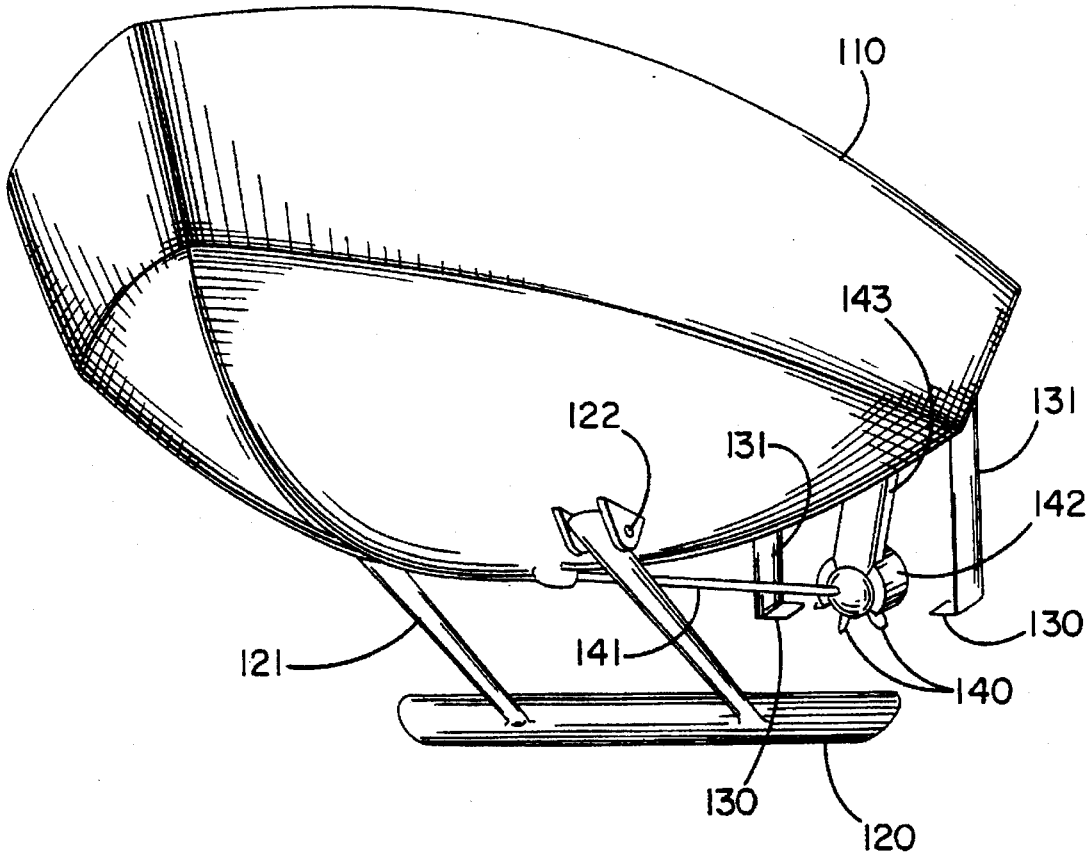
FIG. 14 is a perspective view of the embodiment of FIG. 12 as view from the bow.

The hydrofoil craft can be propelled by any suitable propulsion device, such as a propeller 140 driven by an unillustrated engine mounted inside the hull 110 through a propeller shaft 141 extending diagonally downwards from the hull 110. The propeller thrust can be reacted by a thrust bearing inside a bearing housing and transmitted to the hull 110 via a propeller support strut. In this embodiment, the propeller 140 is at least partially surrounded by a streamlined cowling 142 which communicates with the atmosphere through a hollow ventilating tube 143 having a bore 144 with an upper end disposed above the surface of the water. The lower end **144*a* of the bore 144 opens onto the inside of the cowling 142 on the suction side of the propeller 140. The portion of the ventilating tube 143 which is submerged during operation of the hydrofoil craft preferably has a streamlined cross-section so as to reduce drag. As shown in FIG. 15, in the present embodiment, the cowling 142 extends around the upper portion of the propeller 140 for somewhat over 180 degrees, but the exact dimensions of the cowling 142** are not critical.

The cowling 142 and the ventilating tube 143 help to stabilize the thrust of the propeller 140 during operation in waves. The depth of the propeller 140 beneath the water surface will fluctuate with the rise and fall of waves, and at times, portions of the propeller 140 may be above the water surface. Without the cowling 142 and the ventilating tube 143, the periodic rise of the propeller 140 above the water surface would result in large fluctuations of the torque and rotational speed of the propeller 140, since at times, the entire propeller 140 would be submerged, and at other times, only a portion of the propeller 140 would be below the water surface.

Figure 12:
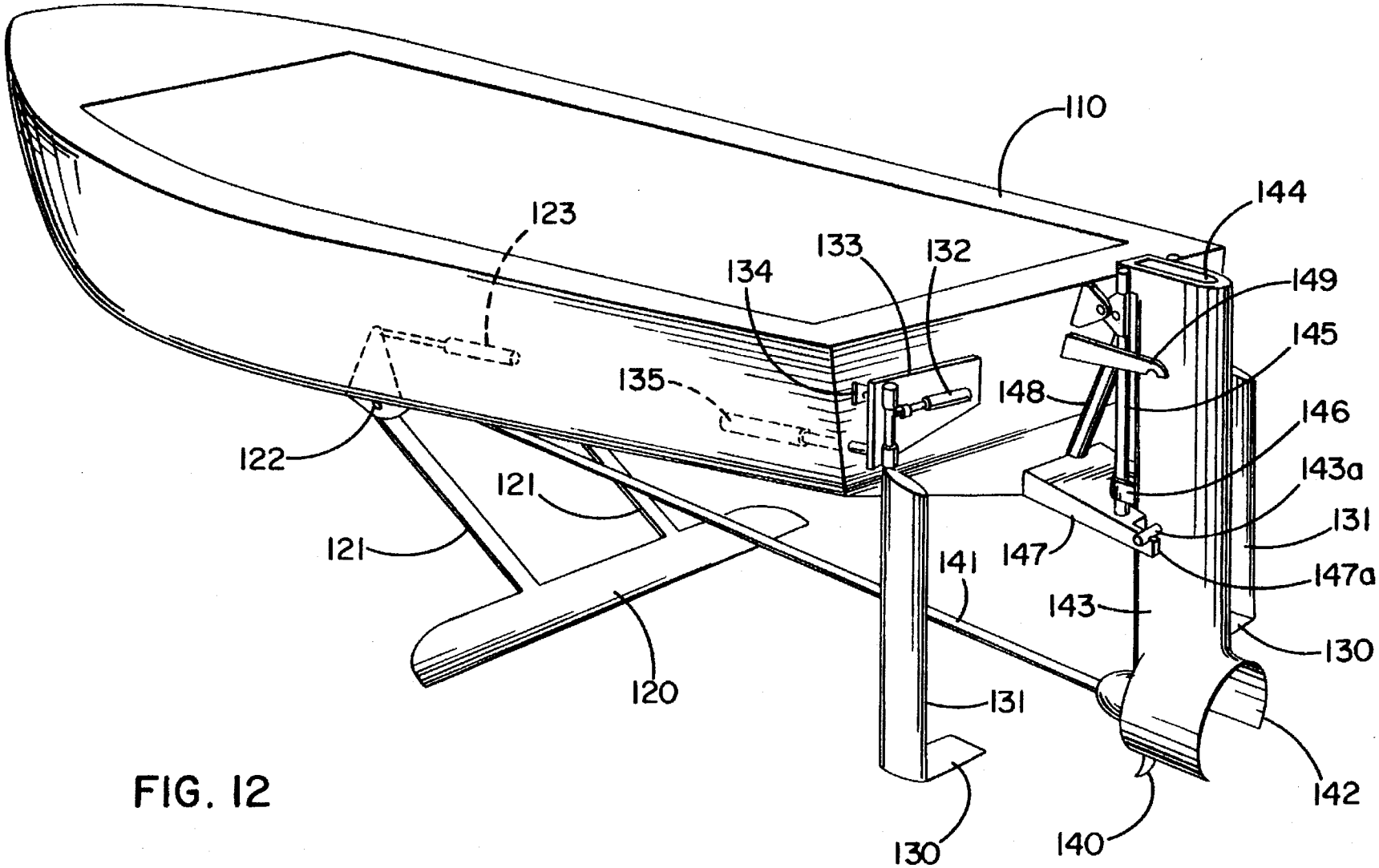
FIG. 12 is a perspective view of another embodiment of a hydrofoil craft according to the present invention as viewed from the stern.

However, in the embodiment of FIG. 12, atmospheric air at the upper end of the ventilating tube 143 is drawn through the ventilating tube 143 and into the cowling 142 by the suction generated by the rotation of the propeller 140, and this causes the local water surface within the cowling 142 to be depressed and expose the upper portion of the propeller 140 to air, whereby less than the entire propeller 140 is immersed. For example, the water level within the cowling 142 can be lowered to approximately the level of the propeller shaft 141 so that only the lower half of the propeller 140 develops thrust. Therefore, the level of the water surface within the cowling 142 with respect to the propeller 140 can be maintained approximately constant regardless in fluctuations in the water surface outside the cowling 142. The net effect is that the power required to drive the propeller 140 is about the same whether the propeller 140 is closed to the water surface or deeply submerged. The cowling 142 accentuates the suction generated by the propeller 140 and also ensures that the air sucked down the ventilating tube 143 flows through the propeller disc.

Another advantage of the cowling 142 and the ventilating tube 143 is that cavitation can never occur on the propeller blades because their suction face is ventilated at atmospheric pressure. This increases the lifespan of the propeller 140 by preventing damage due to cavitation.

Figure 13:
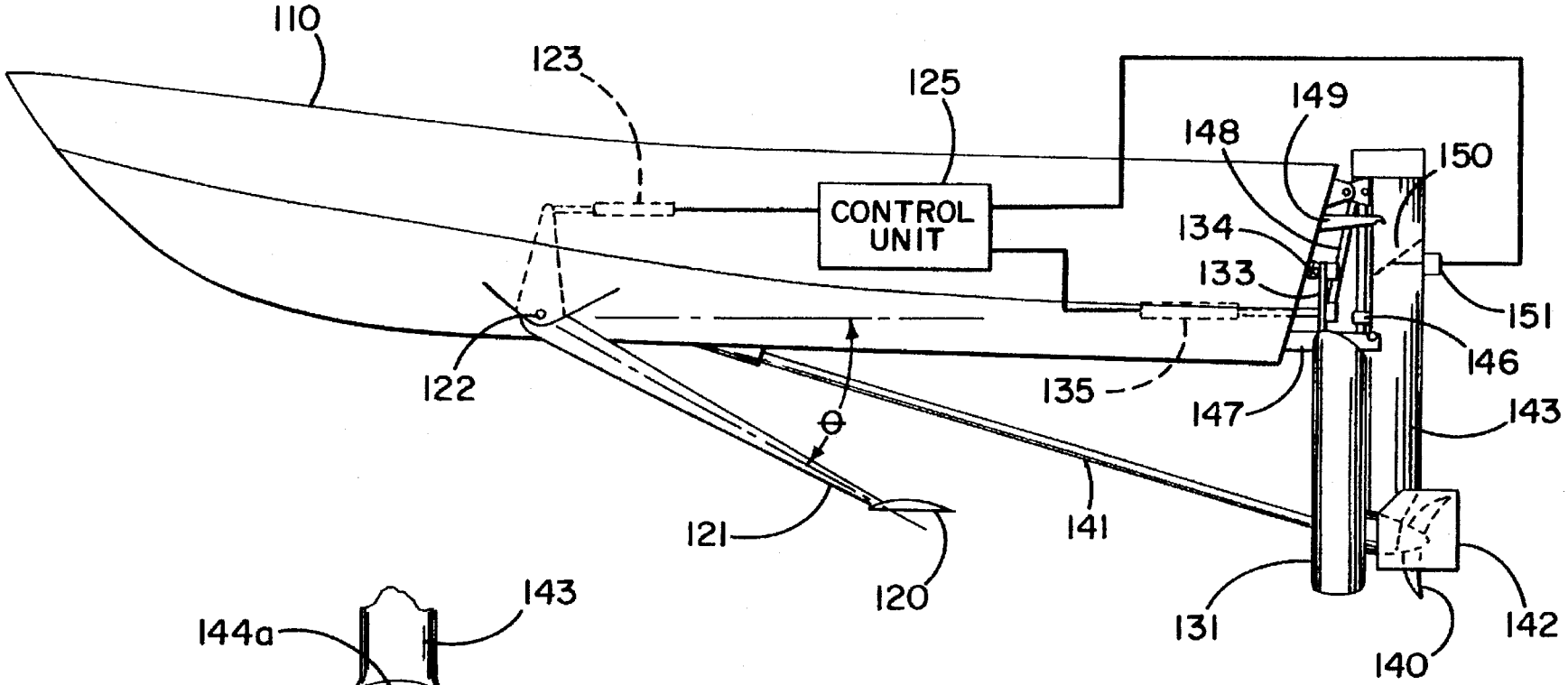
FIG. 13 is a schematic side elevation of the embodiment of FIG. 12.

Preferably, the ventilating tube 143 is equipped with means for varying the air flow rate through the ventilating tube 143. For example, as shown in FIG. 13, a remotely controllable flow valve such as a butterfly valve 150 can be installed in the bore 144 at any convenient location. The butterfly valve 150 is opened and closed by a suitable actuator 151, which can be controlled by the control unit 125. As the butterfly valve 150 is moved towards a closed position, the supply of air to the propeller 140 is reduced, and the propeller 140 is more heavily loaded.

The bore 144 of the ventilating tube 143 is preferably sized so that when the butterfly valve 150 is fully open and the craft is running at its design speed, the water level within the cowling 142 will be lowered to a desired level. The dimensions of the bore 144 of the ventilating tube 143 can be calculated roughly as follows. If V is the boat's design speed and $A_p$ is the swept area of the propeller disc, the required air flow rate through the bore 144 so that the upper half of the propeller 140 will be ventilated is $$0.5\ VA_p\ (\text{ft}^3/\text{second})$$

It is desirable to keep the air velocity in the bore 144 below one-quarter the speed of sound in air (about 280 feet per second), so the minimum desirable area of the bore 144 in order to ventilate the upper half of the propeller 140 is $$VA_p/560\ (\text{square feet}).$$

The propeller 140 may be supported at a fixed location with respect to the hull 110. However, during operation of the hydrofoil craft, the optimal operating depth of the propeller 140 below the surface of the water will vary in accordance with the speed of the hydrofoil craft. Therefore, in the present embodiment, the propeller 140 is supported such that it can be raised and lowered at will, while the hydrofoil craft is moving. The ventilating tube 143 is slidably connected by one or more connectors 146 to a guide rod 145 extending upwards from a support base 147 connected to the stern of the hull 110. The ventilating tube 143 can be raised and lowered by any suitable actuator, such as a hydraulic actuator 148 connected between the ventilating tube 143 and the support base 147 and controlled by the control unit 125. The range of vertical movement of the ventilating tube 143 is limited by engagement between a pin 143*a* secured to the exterior of the ventilating tube 143 and a lower stopper arm 147*a* attached to the support base 147 or an upper stopper arm 149 secured to the transom. In the figures, the ventilating tube 143 is shown in a lowered position in which the pin 143 contacts the lower stopper arm 147*a*. The propeller shaft 141 is pivotable with respect to the hull 110, and the cowling 142 is connected to the propeller 140 such that operation of the actuator 148 causes the propeller 140, the propeller shaft 141, the cowling 142, and the venting tube 143 to move up and down as a single unit. The propeller shaft 141 can be connected to the hull 110 by a cardon joint (or "Hook's joint"), for example, to enable it to pivot with respect to the hull 140.

Structuring the ventilating tube 143 so that it can be raised and lowered also provides the advantage that the draft of the boat can be reduced when it is moving slowly or stationary. The rudders 131 can also be raised to a retracted position by extending the actuators 135 to rotate the support plates 133 about the hinges 134.

In FIG. 12, the main foil 120 is shown rigidly connected to the support arms 121. However, as shown in FIGS. 16*a*–16*c*, the main foil 120 can be pivotably connected to the support arms 121. In these figures, which are respectively a bottom plan view, a partially cross-sectional side view, and a top plan view, the main foil 120 is connected to the support arms 121 for pivoting about a pivot point 120*a*. The main foil 120 can freely pivot downwards about the pivot point 120*a* to at least an angle in which it is "feathered", i.e., approximately aligned with the axis of the support arms 121. However, its pivoting motion in the upwards direction is limited by a stopper member secured to each support arm 121. In this embodiment, the stopper member is a stopper arm 121*a* extending from the rear and of each support arm 121 over the leading edge of the main foil 120. When the hydrofoil craft is operating in calm water without upgusts or downgusts, lift forces on the main foil 120 urge it to the position shown by solid lines in FIG. 16*b* in which the upper surface of the main foil 120 is pressed against the stopper arms 121*a*. Similarly, when the main foil 120 is subject to an upgust, it will be pressed against the stopper arm 121*a*. When the main foil 120 is subjected to a downgust of sufficient magnitude, it will pivot downwards about the pivot point 120*a* in the clockwise direction in FIG. 16*c* to the position shown by dashed lines. Pivotably connecting the main foil 120 to the support arms 121 in this manner decreases the fluid resistance of the main foil 120 when it is in a retracted position, because the main foil 120 can pivot to the angle of least resistance.

When the main foil 120 is subjected to an upgust, the direction of the hydrodynamic force vector acting on the main foil 120 shifts relative to its direction when the main foil 120 is stationary. In order for the main foil 120 to be stable in an upgust, the hydrodynamic force vector should lie along a line which interests the hull at a point to the rear of the transverse axis 122 about which the support arms 121 pivot. This line usually intersects the main foil 120 at approximately its quarter chord. If this line passes to the rear of the transverse axis 122, an upgust will cause the support arms 121 to pivot backwards about the transverse axis 122, as desired. However, if the hydrodynamic force vector lies along a line passing forward of the transverse axis 122, an upgust will cause the support arms 121 to pivot forward instead of backwards. As the support arms 121 pivot forwards, the angle of incidence of the main foil 120 will increase, further increasing the lift acting on the main foil 120 and creating an unstable situation in which the support arms 121 continue to pivot forwards until they violently encounter some mechanical stop. As a result, a large and undesirable upward acceleration will be imparted to the hull 110.

The direction of the force vector will depend on the velocity of the upgusts acting on the main foil 120, which is probabilistic in nature. The closer the support arms 121 are to the vertical, the higher is the probability that an upgust will occur that will cause the support arms 121 to pivot forwards instead of backwards. In order to reduce the probability of the support arms 121 pivoting forward to a low level and guarantee safe operation, the angle 8 with respect to the horizontal of a line between the transverse axis 122 and the quarter-chord of the main foil 120 when the hull 110 is foil-borne and the main foil 120 is substantially stationary with respect to the hull 110 is preferably less than approximately 60 degrees and more preferably less than approximately 40 degrees. Exemplary values within these preferred ranges include all integer and fractional values from 0 to 60 degrees, and examples of suitable ranges within these preferred ranges include from 10 degrees to 40 degrees, from 0 degrees to less than 30 degrees, and from greater than 30 degrees to 60 degrees. These preferred ranges of angles also apply to the embodiments shown in FIGS. 1–11 in which the support arms are at an angle with respect to the vertical. In the example shown in FIG. 12, with the hull 110 foil-borne in calm water, the angle θ is approximately 30 degrees.

Figure 17:
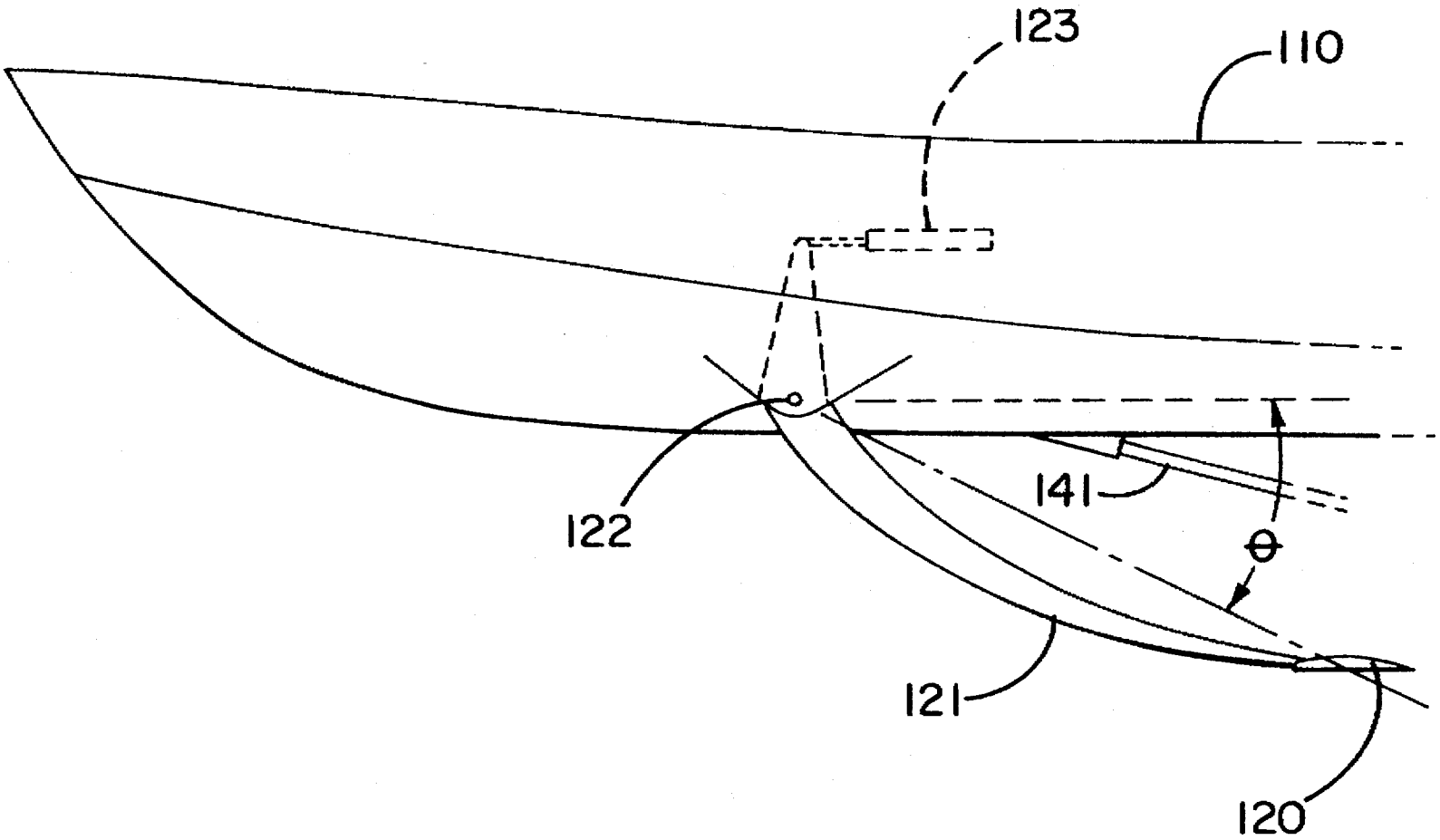
FIG. 17 is a schematic side view showing a variation of the embodiment of FIG. 12 having curved support arms.

In FIG. 12, the support arms 121 are substantially straight members, but as shown in FIG. 17, it is also possible for the support arms 121 to be curved between the transverse axis 122 and the main foil 120. In this case as well, to give adequate foil stability, the angle θ is preferably in the same range as when the support arms 121 are straight.

Figure 18:
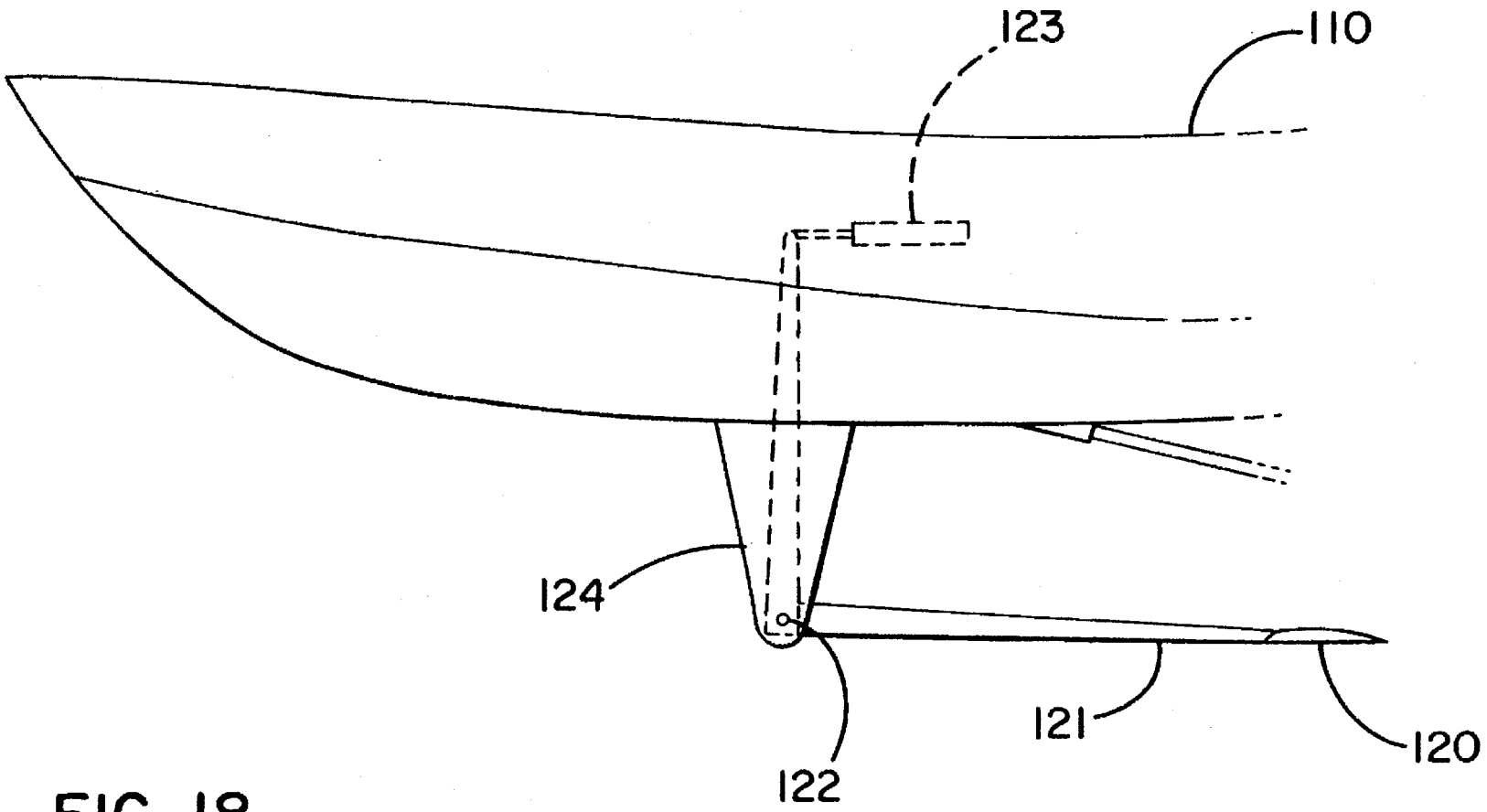
FIG. 18 is a schematic side view of an embodiment having substantially horizontally extending support arms.

The smaller the mean angle of the support arms with respect to the horizontal, the smaller are the vertical force fluctuations transmitted to the hull, and therefore the smoother the ride. Thus, the ride is smoothest when the angle of the support arms to the horizontal is zero. FIG. 18 illustrates a variation of the embodiment of FIG. 12 in which the support arms 121 are supported such that their mean angle with respect to the horizontal in calm water is approximately zero. Instead of support arms 121 being pivotably supported by the hull 110 itself, they are supported for pivoting about a transverse axis 122 by a rigid strut 124 extending downward from the bottom of the hull 110. A shock strut 123 is connected to one or both support arms 121 such that the support arms 121 are substantially horizontal when the hull 110 is foil-borne in calm water and such that the support arms 121 can pivot about the transverse axis 122 to permit the main foil 120 to move in concert with upgusts and downgusts of water surrounding the main foil 120. In this embodiment, the shock strut 123 is connected to a rigid extension of the support arms 121 which extends from the transverse axis 122 into the hull 110. However, the manner of connecting the shock strut 123 to the support arms 121 is not critical. For example, it can be connected to the support arms 121 at a point between the transverse axis 122 and the main foil 120. As in the previous embodiments, the number of support arms 121 is not critical.

One of the problems encountered with hydrofoil craft is running aground or collisions with submerged floating objects such as logs, fishing nets, or large sea animals, including whales. In order to minimize damage to the hydrofoil craft of the present invention in the event of such a collision, the hydraulic system for controlling the movement of the support arms 121 may include an arrangement to allow the support arms 121 and the main foil 120 to fold up rapidly against the hull 110 upon impact of the support arms.121 or the main foil 120 against an underwater object. For example, a relief valve or a hydraulic fuse can be connected to the high pressure side of the shock strut 123. When the support arms 121 or the foil 120 strike against an object, the support arms 121 will attempt to pivot upwards and backwards against the biasing force of the shock strut 123 and will produce a sudden increase in the pressure on the high pressure side of the shock strut 123. The sudden increase in pressure will open the relief valve or rupture the hydraulic fuse, thereby allowing hydraulic fluid to rapidly exit from the hydraulic strut 123 into an auxiliary reservoir, for example, and relieve the fluid pressure acting on the support arms 121 through the shock strut 123. As a result, the support arms 121 can swing upwards towards the hull 121 without large forces being applied to the support arms 121 or the hull 110, such as would occur if the support arms 121 were rigidly connected to the hull 110. Instead of being vented to a reservoir, the high pressure fluid which passes through the relief valve or diaphragm may be directed to the actuators 135 and 148 for the rudders 131 and the ventilating tube 143, respectively, to swing the rudders 131 upwards and backwards and to lift the ventilating tube 131, the propeller 140, and the propeller shaft 141 upwards and out of the way of the object which struck the main foil 120. Safety arrangements employing relief valves, hydraulic fuses, etc. for allowing a release of hydraulic pressure in a hydraulic system are well known to those skilled in the art, and any suitable arrangement can be employed. Not only does the ability of the main foil 120 and the support arms 121 to move upwards rapidly in this manner reduce damage to the hydrofoil craft itself and the shocks imparted to passengers aboard the hydrofoil craft, but it is expected to reduce the danger to sealife, since the main foil 120 will tend to slide harmlessly over the bodies of animals which it encounters.

Figure 19:
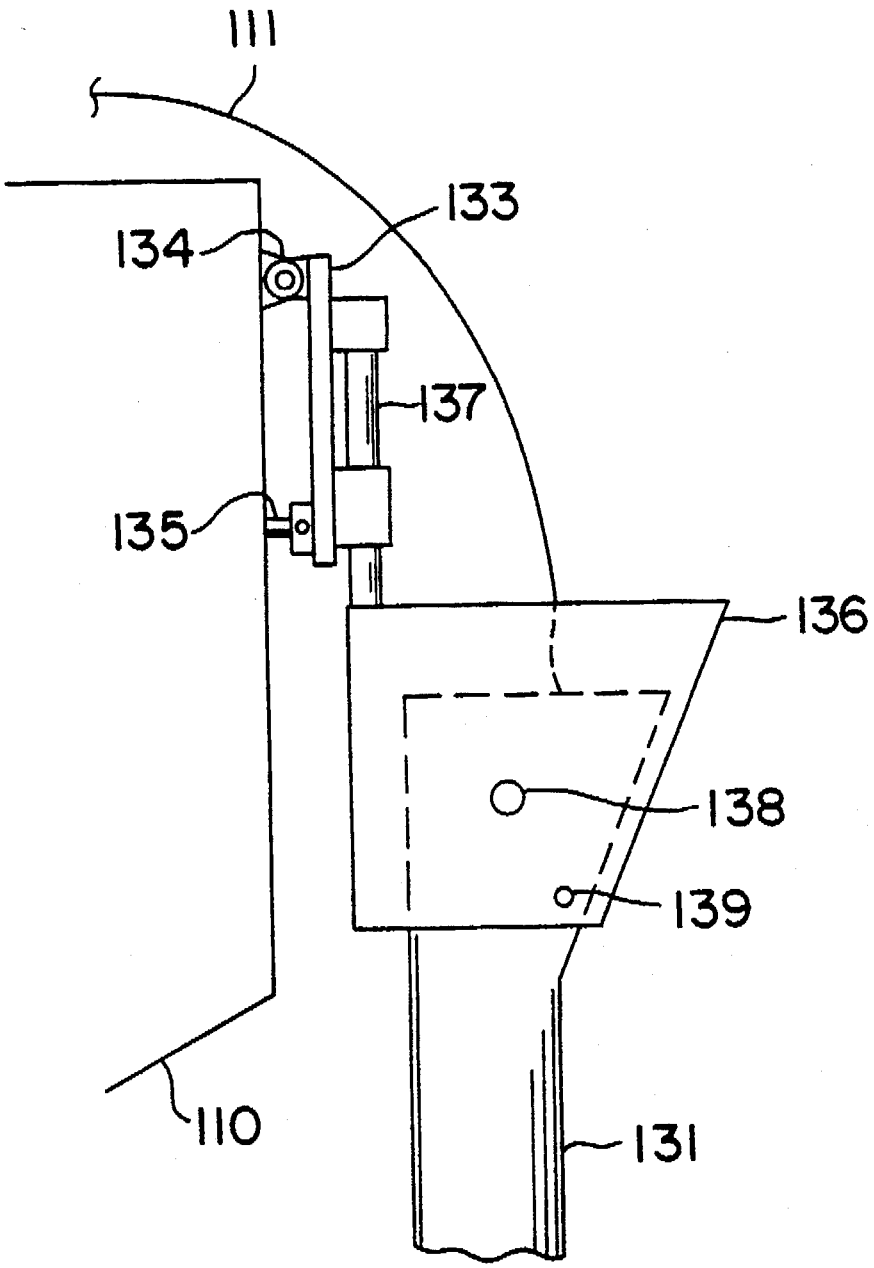
FIG. 19 is a side elevation of an arrangement for preventing damage to the rudders of the embodiment of FIG. 12.

A similar hydraulic arrangement can be used to allow the rudders 131 supporting the auxiliary foils 130 to quickly pivot upwards and backwards in the event that the rudders 131 or the auxiliary foils 130 strike against an underwater object. A different arrangement for preventing damage in the event of a collision is shown in FIG. 19, which is a side elevation of the upper portion of one of the rudders 131 of another embodiment of the present invention. The upper end of the rudder 131 is supported by a frame 136, which acts as a socket for the rudder 130. The frame 136 is secured to a rudder stock 137 which is pivotably mounted on a plate 133, which is pivotably mounted on the stern of a hull 110 in the same manner as in the embodiment of FIG. 12, and the other portions of the hydrofoil craft may be the same as in that embodiment. The rudder 131 is secured to the frame 136 by first and second shear pins 138 and 139 passing through the upper portion of the rudder 131. The first shear pin 138 is designed to withstand a greater stress than the second shear pin 139. When the rudder 131 or the unillustrated auxiliary foil 130 mounted at the bottom end of the rudder 131 strikes an object as the hydrofoil craft is moving forward (to the left in the figure), a rearward force acts on the rudder 131, producing a counterclockwise torque on the rudder 131 about the first shear pin 138. At a certain torque, greater than that expected to be exerted on the rudder 131 during normal operation, the second shear pin 139 breaks, and the rudder 131 is free to rotate in the counterclockwise direction about the first shear pin 138. In many cases, the rotation of the rudder 131 about the first shear pin 138 will allow the auxiliary foil 130 to slide over or otherwise move free of the object which was struck. In such cases, no large forces act on the rudder 131 after it begins to rotate, and the only portion of the hydrofoil craft to suffer any damage is the second shear pin 139, which is easily replaced. However, if the cause of the impact was running aground, the auxiliary foil 130 may dig into the ground like an anchor as the rudder 131 pivots backwards after rupture of the second shear pin 139. To prevent the rudder 131 from exerting a damaging jerking force on the hydrofoil craft in this situation, the first shear pin 138 is designed to break when the axial force acting on the rudder 131 reaches a certain value to allow the rudder 131 to come completely loose from the frame 136 without damage to the rudder 131 or the frame 136. Ideally, the only portions of the hydrofoil craft that suffer any damage are the shear pins 138 and 139. In order to make it possible to subsequently recover the rudder 131 after it comes loose from the frame 136, the rudder 131 may be connected to the hull 110 by means of a flexible line 111 which is automatically paid out from an unillustrated reel inside the hull, for example. After the hydrofoil craft has come to a safe stop following the collision, the line 111 can be reeled in and the rudder 131 brought back aboard the hydrofoil craft.

During operation of a hydrofoil craft, forces acting on the foils may apply a rolling moment to the foils. In a hydrofoil craft with an automatic control system, when rolling of the craft is detected, flaps on the foils are automatically adjusted to adjust the lift on the foils and automatically return the hull to a level position. However, automatic control systems and foils with adjustable flaps are complicated and expensive to manufacture.

Figure 20:
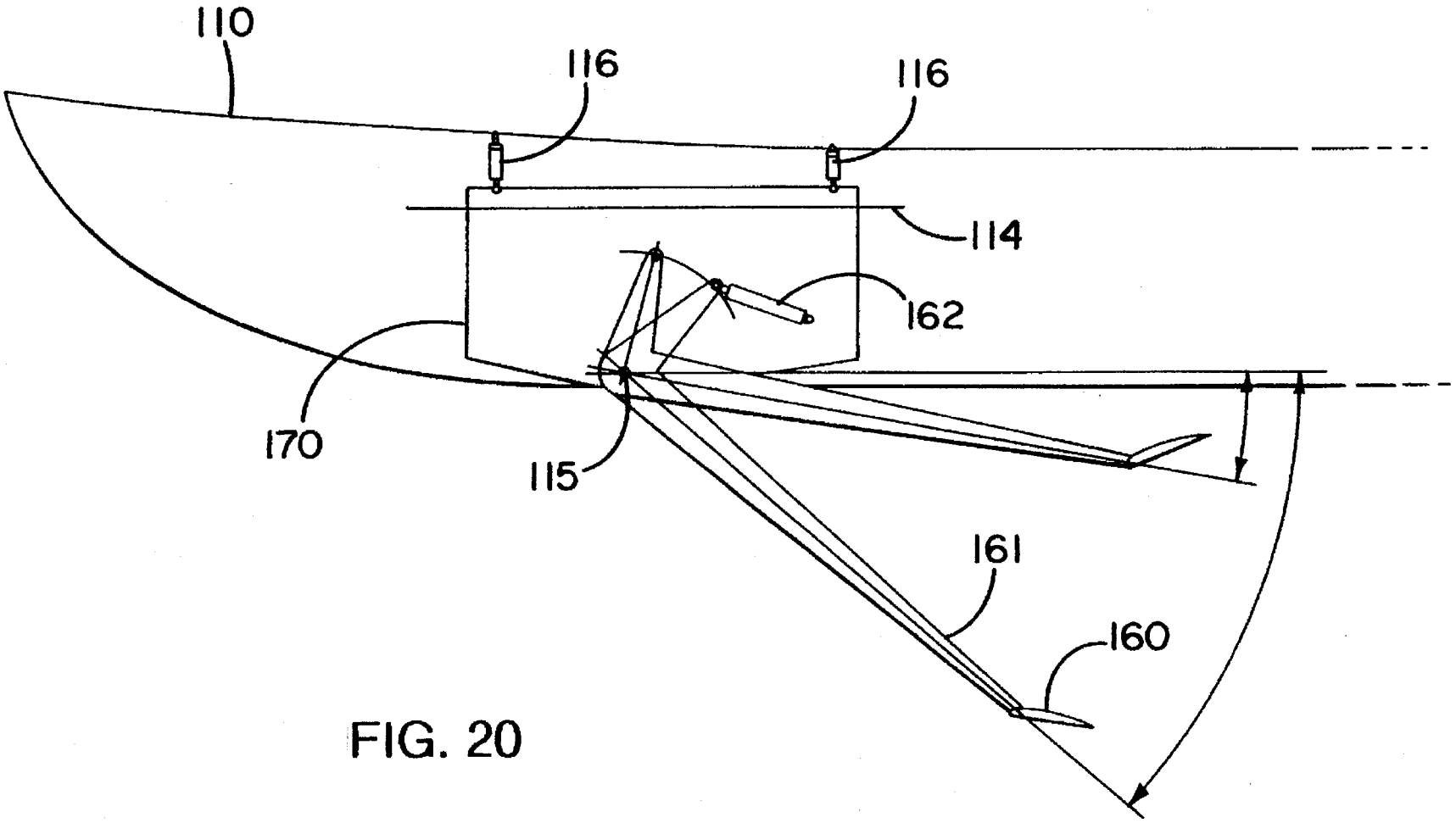
FIG. 20 is a schematic side view of another embodiment of the present invention having laterally pivoting support arms.
Figure 21:
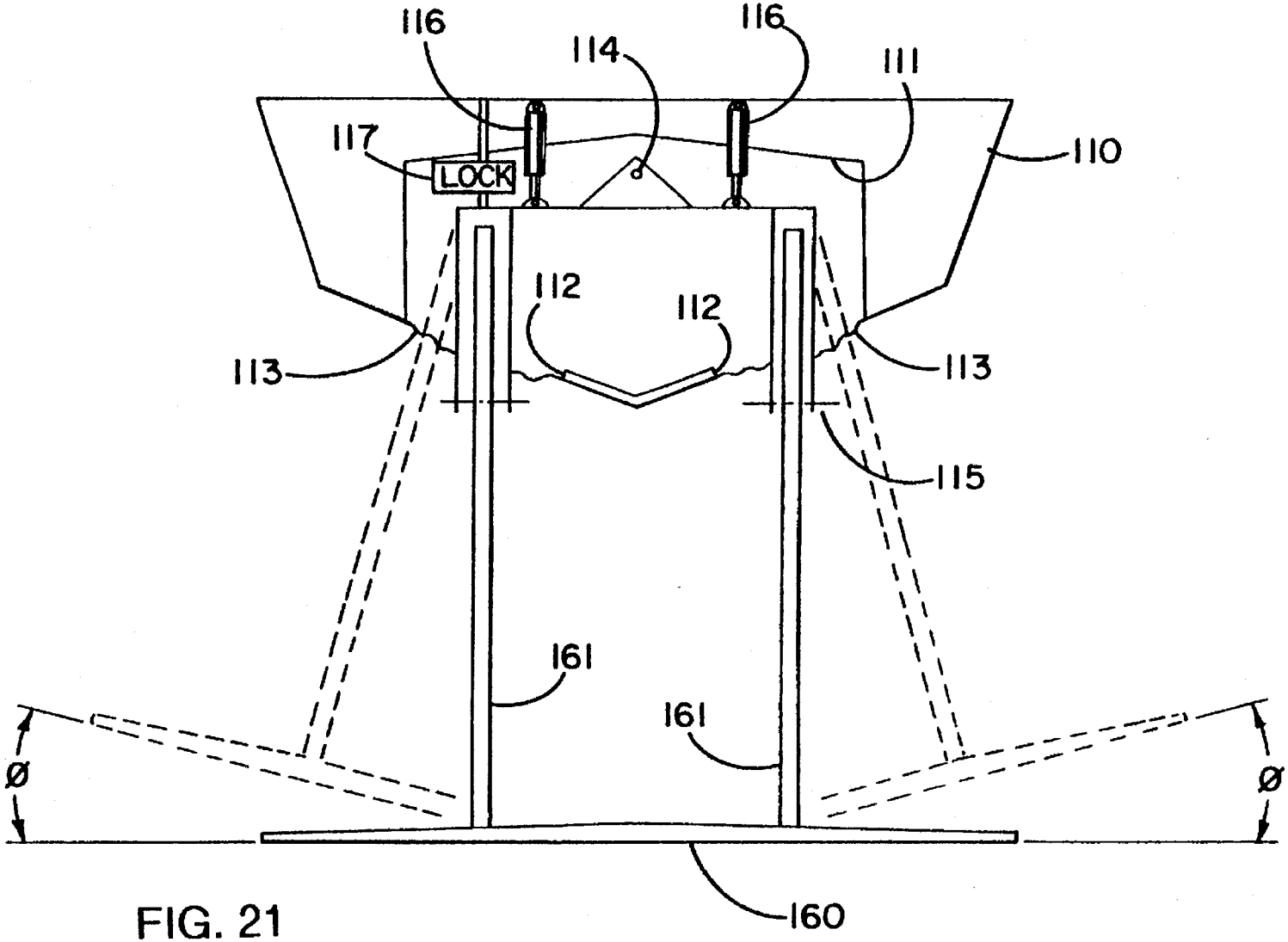
FIG. 21 is a transverse cross-sectional view of the embodiment of FIG. 20.

FIGS. 20 and 21 schematically illustrate an embodiment of a hydrofoil according to the present invention which is able to reduce the effect of rolling forces on the hydrofoil craft with a simple and economical structure. FIG. 20 is a schematic side view of a portion of this embodiment, and FIG. 21 is a schematic transverse cross-sectional view. In this embodiment, one or more support arms 161 for supporting a hull 110 atop a main foil 160 are connected to the hull 110 so that the foil 160 and the support arms 161 can pivot together about an axis 114 extending generally in the longitudinal direction, i.e., the fore and aft direction of the hull 110. This longitudinal axis 114 preferably lies along the centerline plane of the hull 110 and is preferably substantially parallel to the water surface when the hull 110 is foil-borne and operating at its customary trim.

The support arms 161 are connected to a support frame 170 which is pivotably connected to the hull 110 for pivoting about the longitudinal axis 114. The support frame 170 is disposed within a cavity 111 in the hull 110, and the support arms 161 extend through corresponding openings 112 in the bottom surface of the hull 110. In the case of a catamaran vessel with twin hulls, the support frame 170 can be disposed between the hulls. The openings 112 can be equipped with flexible seals 113 attached between the hull 110 and the support frame 170 if it is desired to prevent water from entering into the cavity 111 via the openings 112 during foil-borne operation of the craft.

The support arms 161 can be rigidly connected to the support frame 170, but preferably they are supported such that the foil 160 can move up and down in concert with upgusts and downgusts of water surrounding the foil 160 and thereby maintain the hull 110 at a substantially constant height above the mean water level during foil-borne operation. For example, the support arms 161 can be connected to the support frame 170 so that they can pivot about a transverse axis 115 extending substantially perpendicular to the centerline of the hull 110 and to the longitudinal axis 114. As in the embodiment of FIG. 12, a shock strut 162 is connected between the support frame 170 and the upper ends of one or both support arms 161. Alternatively, shock struts 162 can be connected to the support arms 161 at a point between the transverse axis 115 and the foil 160, as in the embodiment of FIG. 1. Any of the other arrangements disclosed in the preceding embodiments for enabling up and down movement of a foil can also be used.

As shown in FIG. 21, the support frame 170 and the support arms 161 can pivot about the longitudinal axis 114 by up to an angle $\phi$ from a centered position shown by the solid lines in the figure, in which the foil 160 is horizontal and centered with respect to the centerline plane of the hull 100, to either of the positions shown by dashed lines. The value of the angle $\phi$ is not critical, and will depend upon the operating conditions of the vessel. A roll angle of approximately 15 degrees is the greatest that is likely to be encountered in random waves, so in the present embodiment, the supports arms 161 can pivot about the longitudinal axis 114 by up to 15 degrees in each direction from the centered position. The angle of pivoting in either direction from the centered position can be limited by any suitable means, such as by stops attached to the hull 110 or by the edges of the openings 112 in the hull 110.

The center of gravity of the hull 110 can be located either above or below the longitudinal axis 114. If the center of gravity is located below the longitudinal axis 114, the hull 110 will be stably supported without the need for any restraining members connected between the support frame 170 and the hull 110. However, some resilient biasing means is generally desirable to bias the support frame 170 to a central position with respect to the hull 110 and to provide sufficient damping to prevent resonance when the natural frequency of the hull 110 about longitudinal axis 114 coincides with the frequency of waves acting on the craft. An example of a suitable biasing means is one or more shock struts 116 connected between the support frame 170 and the hull 110. The shock struts 116 need not be of any particular type and can be similar to the shock strut 162 connected to the support arms 162. Preferably, the shock struts 116 are adjustable so that their spring constant can be varied in accordance with operating conditions of the hydrofoil craft.

There may be situations in which it is desirable to lock the position of the support frame 170 with respect to the hull 110. The shock struts 116 can be designed so that they can be locked to form a rigid connection between the hull 110 and the support frame 170, or a separate locking mechanism can be provided between the hull 110 and the support frame 170.

FIGS. 20 and 21 illustrate only a single foil 160 for supporting the hull 110. However, the hull 110 may be equipped with a plurality of foils, and each of these foils may be supported in a manner permitting the support arms for each of the foils to pivot about a longitudinal axis.

Figure 22:
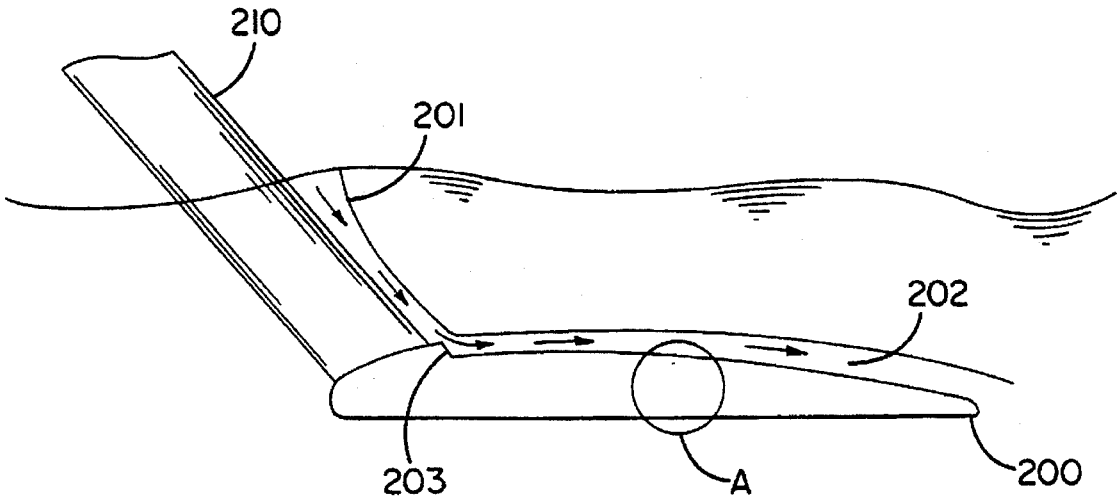
FIG. 22 is a side view of a portion of an embodiment of the present invention having a ventilated foil.

As described above with respect to the embodiment of FIGS. 9 and 10, a hydrofoil craft according to the present invention may employ a ventilated foil, i.e., one which is completely submerged yet has an upper surface which is ventilated with atmospheric air supplied via a support arm for the foil. This feature of the present invention will be described in greater detail with respect to FIG. 22, which is a schematic side elevation of a ventilated foil 200 of an embodiment of a hydrofoil craft according to the present invention. In this figure and in subsequent figures showing a side elevation of a foil, the foil and the hydrofoil craft are assumed to be traveling to the left in the figure, and the structure of the unillustrated portions of the hydrofoil craft may be the same as in any of the preceding embodiments, such as the embodiment of FIG. 12. The hydrofoil craft will typically have a plurality of foils, each of which can ventilated, but only a single foil is shown in FIG. 22 for ease of illustration. The illustrated foil 200 is a main foil which supports a major portion of the weight of the hydrofoil craft, but it can instead be an auxiliary foil used primarily for stabilizing the craft, like the auxiliary foils 130 of FIG. 12. The foil 200 is connected to the unillustrated hull of the craft by one or more support arms 210, which can be ones which maintain the position of the foil 200 constant with respect to the hull, but preferably are ones which support the foil 200 so that it can move in concert with upgusts and downgusts in the water surrounding the foil 200, as in any of the preceding embodiments.

Atmospheric air is supplied to the foil 200 as the foil 200 moves through the water to form an air-filled cavity 202 contacting most of the upper surface of the foil 200. The air can be supplied to the foil 200 along the outer surface of the support arm(s) 210, along the inside of the support arm(s) 210, along a conduit attached to the support arm(s) 210, or by a combination of the above routes. If the hydrofoil craft is equipped with a plurality of support arms 210 for the foil 200, the air can be supplied via a single one or by more than one of the support arms 210. However, for the sake of simplicity, in the following description, only a single support arm 210 will be referred to.

In the embodiment of FIG. 22, air is supplied to the foil 200 along the trailing edge of the support arm 210. The mechanism by which air is supplied to the foil 200 in this embodiment is as follows. When the hydrofoil craft starts to move through the water, the water flowing over the upper surface of the foil 200 is initially in contact with the foil 200. Because of the convexity of the upper surface of the foil 200, the static pressure on the upper surface is lower than ambient pressure, and suction is produced. The combination of the suction on the upper surface of the foil 200 and the locally low pressure behind the support arm 210 causes an air pocket 201 to form behind the support arm 210. The magnitude of the suction increases with the square of the speed of the foil 200, so as the speed increases, the air pocket 201 extends further and further down the support arm 210 from the water surface, and when the suction reaches a critical value, the air pocket 201 reaches the upper surface of the foil 200, forcing the water to separate from the upper surface and forming an air-filled cavity 202 on the upper surface.

Figure 23A:
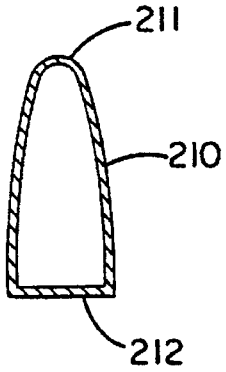
FIGS. 23A–23D are transverse cross-sectional views of various examples of the support arm of the embodiment of FIG. 22.
Figure 23B:
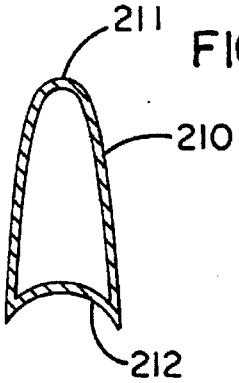
Figure 23C:
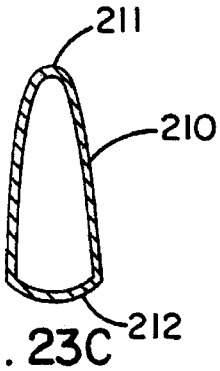
Figure 23D:
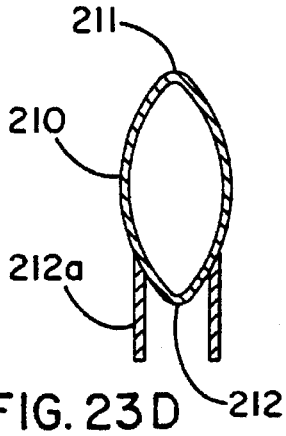

The support arm 210 need not have any particular shape in order for its outer surface to guide air to the upper surface of the foil 200, but preferably it has a blunt (non-streamlined) trailing edge from which the water flow separates to form the pocket 201 through which atmospheric air can travel down to the upper surface of the foil 200. FIG. 23A illustrates an example of the cross-sectional shape of the support arm 210 of FIG. 22. Along its leading edge 211, the support arm 210 has a streamlined shape, while its trailing edge 212 is a blunt, substantially flat surface extending perpendicular to the longitudinal axis of the support arm 210. The blunt trailing edge 212 need not extend over the entire length of the support arm 210 but preferably extends at least from the waterline of the support arm 210 at the normal cruising speed down to the foil 200. Preferably, there is a discontinuity where the trailing edge 212 joins the lateral surfaces of the support arm 210 so that water flow will cleanly separate from the support arm 210 at the discontinuity. As shown in FIG. 23B, instead of being flat, the trailing edge 212 may be concave or angled inwards towards the leading edge 211 to define a recess for the air pocket 201. Alternatively, the trailing edge 212 may be convex, as shown in FIG. 23C, with a discontinuity between the trailing edge 212 and the lateral surfaces of the support arm 210. As shown in FIG. 23D, it is also possible to form a pocket 201 for atmospheric air behind a support arm 210 having a streamlined trailing edge 212 by attaching plates 212*a* to the lateral surfaces of the support arm 210 adjoining the trailing edge 212. At the trailing edges of the plates 212*a*, flow of water can separate to define the air pocket 201 extending along the support arm 210 between the atmosphere and the foil 200.

Upon reaching the upper surface of the foil 200, the air which travels down the support arm 210 spreads laterally over the upper surface and forms a cavity 202 extending over substantially the entire spanwise width of the upper surface of the foil 200 aft of the point at which the trailing edge of the support arm 210 contacts the foil 200. The air supplied to the cavity 202 flows over the trailing edge of the foil 200 and eventually disperses as air bubbles which rise to the surface. The width of the trailing edge 212 of the support arm 210 is preferably selected to maintain close to atmospheric pressure in this cavity 202. The closer is the gas pressure within the cavity 202 to atmospheric pressure, the more stable is the cavity 202 and the less subject to collapse. Therefore, the gas pressure within the cavity 202 is preferably at least 80% of atmospheric pressure, more preferably at least 90%, and still more preferably at least 94%. Assuming that substantially the entire upper surface of the foil 200 is ventilated, then the volume flow rate Q of air through the cavity 202 is approximately $$Q=VSd$$

wherein V is the speed of the foil 200 through the water, S is the span of the foil 200, and d is the height of the cavity 202 measured from the upper surface of the foil 200.

If the width of the blunt trailing edge 212 of the support arm 210 is (t), a roughly triangular cavity having a length of approximately 3 t will form behind the trailing edge 212. The cross-sectional area of this cavity will be approximately $$A=\frac{3}{2}t^2$$

If there are (n) support arms 210 for the foil 200 and each supplies air to the foil 200 at the same rate, the air velocity behind each support arm 210 will be roughly $$u=\frac{Q}{An}=\frac{2VSd}{3t^2n}$$

The pressure drop between the atmosphere and the cavity 202 is therefore $$\Delta p = \tfrac{1}{2}\rho u^2 - \tfrac{1}{2}\rho V^2 = \tfrac{1}{2}\rho V^2[(2Sd/3t^2)^2 - 1]$$

where ρ is the mass density of air. Thus, the pressure drop can be set to a desired value by suitably selecting the width t of the trailing edge 212.

For example, if the span S of the foil 200 is 6 feet, the height d of the cavity 202 is 0.1 feet, and the foil 200 is connected to the hull by two support arms 210 each having a blunt trailing edge with a width t of 0.3 feet, the velocity ratio would be $$\frac{u}{V} = \frac{2Sd}{3nt^2} = \frac{2\times 6\times 0.1}{3\times 2\times .09} = 2.22$$

and the pressure drop would be $$\tfrac{1}{2}\rho V^2(2.22^2-1)=3.93(\tfrac{1}{2}\rho V^2)$$

So, at a boat speed V of 100 knots, the pressure drop would be 133 lb/ft$^2$ (0.92 psi) or approximately a 6% drop from atmospheric pressure.

If the width t of the trailing edge 212 of the support arm 210 is too small, the area of the cavity behind the support arm 210 through which air flows to the foil 200 will be too small, the high air velocity down the support arm 210 will result in significant pressure losses, and the drag of both the support arm 210 and the foil 200 will be increased. It is even possible, given a small enough air supply path, for sonic choking to occur. In addition to substantially increasing the drag of the support arm 210 and the foil 200, this can generate extremely high sound pressure levels.

As in the embodiment of FIG. 12, when the support arm 210 is pivotably supported by the unillustrated hull in a manner such that the foil 200 can move in concert with upgusts and downgusts in the water surrounding the foil 200, the support arm 210 preferably slopes backwards from the axis of pivoting of the support arm 210, i.e., the angle with respect to the horizontal of a line between the axis of pivoting and the quarter-chord of the foil 200 when the hull is foil-borne and the foil 200 is substantially stationary with respect to the hull is preferably less than approximately 60 degrees and more preferably less than approximately 40 degrees. However, even if the support arm 200 is rigidly connected to the hull, the support arm 200 is preferably sloped with respect to the vertical, since as explained earlier, an inclined support arm produces less drag than a vertical one. Therefore, the width of the support arm 200 can be increased to permit more air to flow down its trailing edge without a serious drag penalty.

The advantages, from the standpoint of drag reduction, of a backwardly-sloping support arm also apply to a support arm which is rigidly rather than pivotably connected to the hull. Therefore, when the upper surface of a foil is ventilated by air traveling down the trailing edge of a support arm which is rigidly connected to a hull, the angle with respect to the horizontal of the longitudinal axis of the support arm when the hull is foil-borne in its customary pitch is preferably in the range of approximately 30 to approximately 50 degrees.

The air traveling down the support arm 210 is preferably introduced onto the upper surface of the foil 200 as close to the leading edge of the foil 200 as possible so that atmospheric air traveling down the back of the support arm 210 does not need to force its way against the water flow because it is already upstream of the cavity 202 which it must feed. If no cavity 202 already exists above the foil 200, this atmospheric air traveling down the back of the support arm 210 will allow one to form as soon as it reaches the leading edge of the foil 200. Mounting the foil 200 on the support arm 210 at or near the leading edge of the foil 200 facilitates the introduction of air near the leading edge.

The foil 200 can be either rigidly or pivotably secured to the support arm 210, as in the preceding embodiments. In either case, the means of attachment is preferably such that the angle of incidence of the foil 200 (the angle of the foil relative to a stationary reference plane, such as a horizontal plane) is automatically varied as the foil 200 moves in concert with upgusts and downgusts in the water surrounding it, as described with respect to the preceding embodiments.

The cavity 202 preferably starts no farther back from the leading edge of the foil 200 than 20% of the chord and more preferably no farther back than 5% of the chord. Cavitation is unlikely to occur along the leading edge of the foil 200, so it is not necessary for the cavity 202 to extend all the way to the leading edge of the foil 200. Preferably, however, the front end of the cavity 202 begins no further back than the point at which cavitation would be expected to occur on the upper surface of the foil 200 in the absence of ventilation at the normal cruising speed. The location of this point will depend upon the shape of the foil and its normal operating depth. The cavity 202 preferably extends continuously to the trailing edge of the foil 200.

Due to most of the upper surface of the foil 200 being contacted by the cavity 200 of air at approximately atmospheric pressure, there is no possibility of cavitation occurring on the upper surface.

In the past, it has been proposed to intermittently supply air to the upper surface of a submerged foil via the inside of a support arm for the foil in order to vary the lift generated by the foil in response to changes in depth of the foil and thereby return the foil to a constant depth. In such hydrofoil craft, when a foil begins to rise above a desired depth, air is supplied to the upper surface of the foil to increase the pressure on the upper surface and thereby decrease the lift, causing the foil to return to the desired depth. The area of the foil to which air is supplied is adjusted in accordance with the necessary change in the amount of lift.

In contrast, in the present invention, above a speed at which the cavity 202 can form, air is continuously supplied to the upper surface of the foil 200 regardless of changes in the depth of the foil 200, and the area of the upper surface in contact with air is maintained constant.

Figure 24:
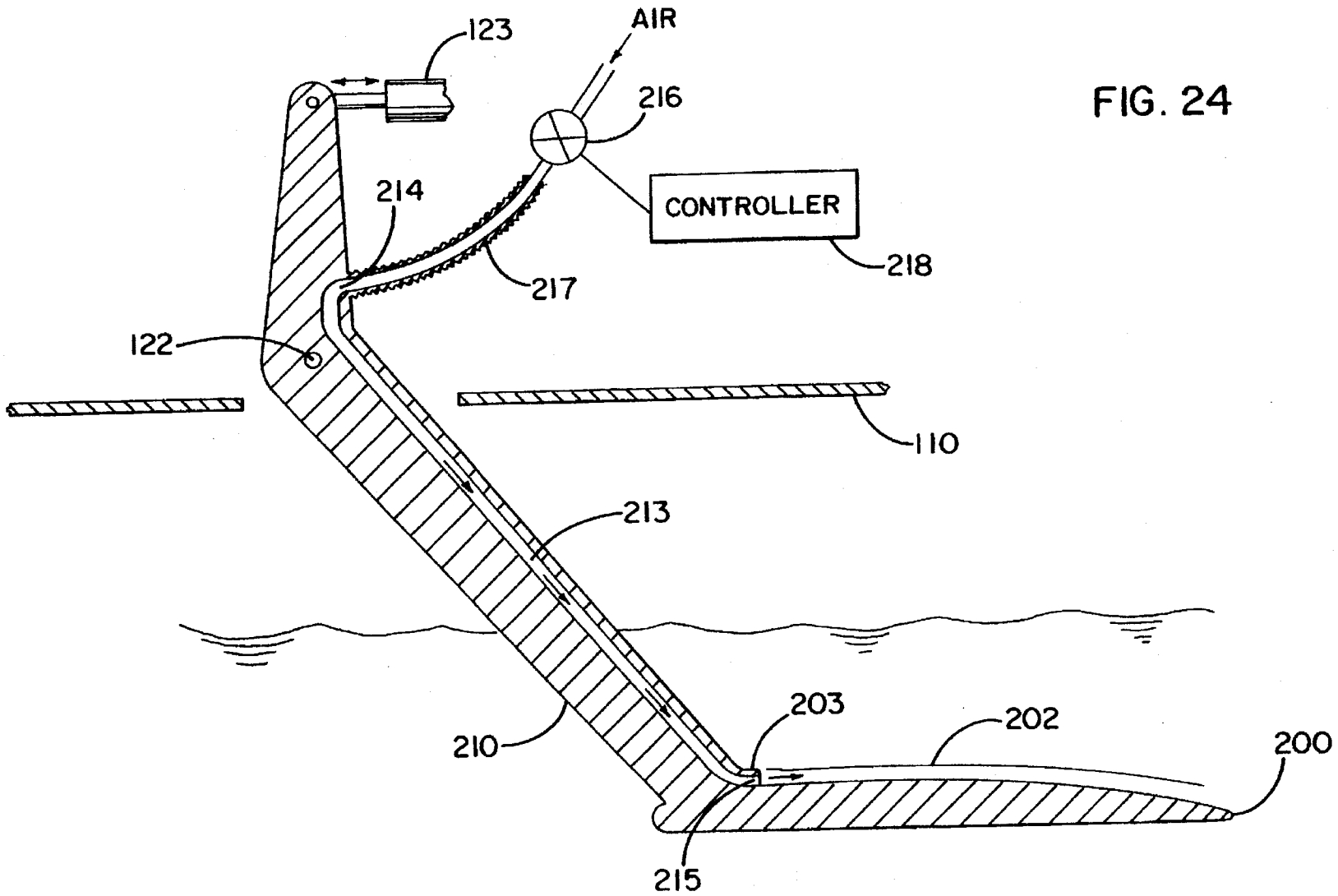
FIG. 24 is a schematic side view of a portion of an embodiment in which air is supplied to a foil through the inside of a support arm for the foil.

In addition to or instead of air being introduced into the cavity 202 above the foil 200 via the outer surface of the support arm 210, air can be introduced into the cavity 202 along an enclosed passage. FIG. 24 illustrates an embodiment in which the support arm 210 contains an internal passage 213 for atmospheric air. As in the preceding embodiments, the support arm 210 is pivotable about a transverse axis 122 and is maintained at a desired angle with respect to the horizontal by a biasing member such as a hydraulic shock strut 123 connected to the upper end of the support arm 210. The internal passage 213 has an inlet 214 which communicates with the atmosphere above the water surface and an outlet 215 which opens onto the outside of the support arm 210 or the upper surface of the foil 200 in the vicinity of the leading edge of the foil 200 and communicates with the top surface of the foil 200. For example, if the foil 200 is hollow, the internal passage 213 may open onto the inside of the foil 200 and communicate with the cavity 202 through one or more holes formed in the top surface of the foil 200. To prevent water from entering the inlet 214, it may be disposed in a protected location above the waterline of the support arm 210, such as inside the hull 110 of the hydrofoil craft. In order to prevent water from entering the outlet 215 when the hydrofoil craft is stationary or moving at low speeds, a check valve may be installed in the outlet 215. If the hydrofoil craft is intended to operate at very high speeds, it may be impractical to make the support arm 210 wide enough to supply the desired quantity of air along the exterior of its trailing edge, on account of the increased drag produced by widening the support arm 210. In such cases, introducing air through an internal passage 213 inside of the support arm 210 is particularly suitable since the passage 213 can be given a large cross section without the support arm 210 having to be wide. If the support arm 210 is hollow, the entire inside of the support arm 210 can be used as the internal passage 213. A valve 216 (which may be operated manually or automatically by a controller 218) may be connected to the internal passage 213 by flexible tubing 217, for example, to regulate the flow rate through the internal passage 213. The dimensions of the internal passage 213 can be selected so as to maintain a desired air pressure close to atmospheric pressure within the cavity 202 based on the same principles used to select the width of the trailing edge in the embodiment of FIG. 22. The suction generated on the upper surface of the foil 200 draws air from the atmosphere through the internal passage 213 and onto the upper surface.

If the internal passage 213 within the support arm 210 is sufficiently large to supply air to the upper surface of the foil 200 at the desired flow rate, it is not necessary to supply air along the trailing edge of the support arm 210, and the trailing edge may be streamlined instead of blunt so as to reduce drag.

Figure 25:
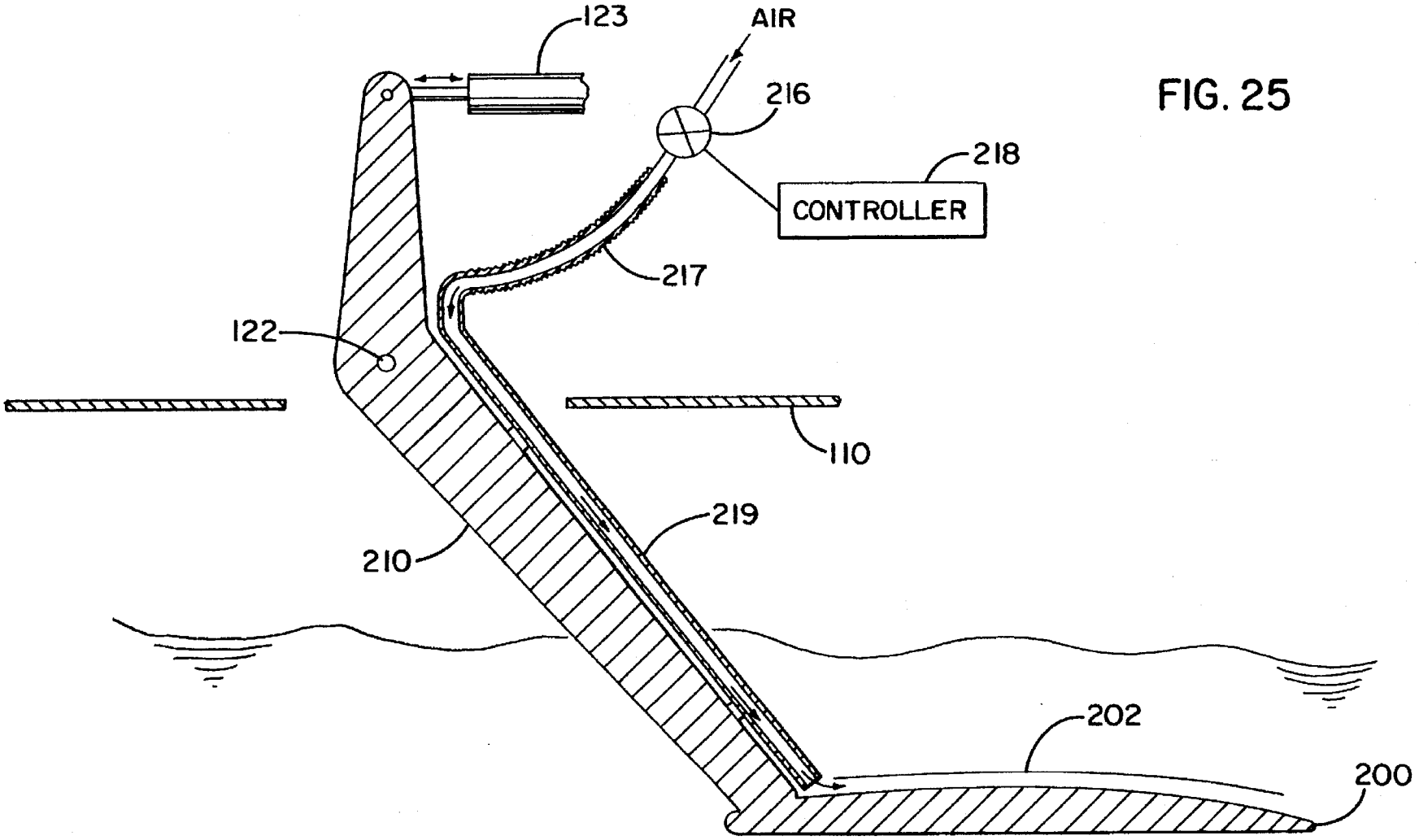
FIG. 25 is a schematic side view of a portion of an embodiment having an external conduit for supplying air to a foil.

To reduce drag, an enclosed passage for air is preferably disposed within the support arm 210. However, as shown in FIG. 25, a passage for atmospheric air may instead comprise a hollow conduit 219 mounted on the outside of the support arm 210, such as on the trailing edge of the support arm 210. The conduit 219 has an upper end which communicates with the atmosphere and a lower end disposed in the vicinity of the upper surface of the foil 200 near the leading edge. A valve 216 (which may be operated manually or automatically by a controller 218) may be connected to the upper end of the conduit 219 by flexible tubing 217, for example, to regulate the flow of air through the conduit 219. An external conduit 219 can be employed to economically retrofit an existing support arm in which it would be difficult or impossible to form an internal air supply passage.

Figure 26:
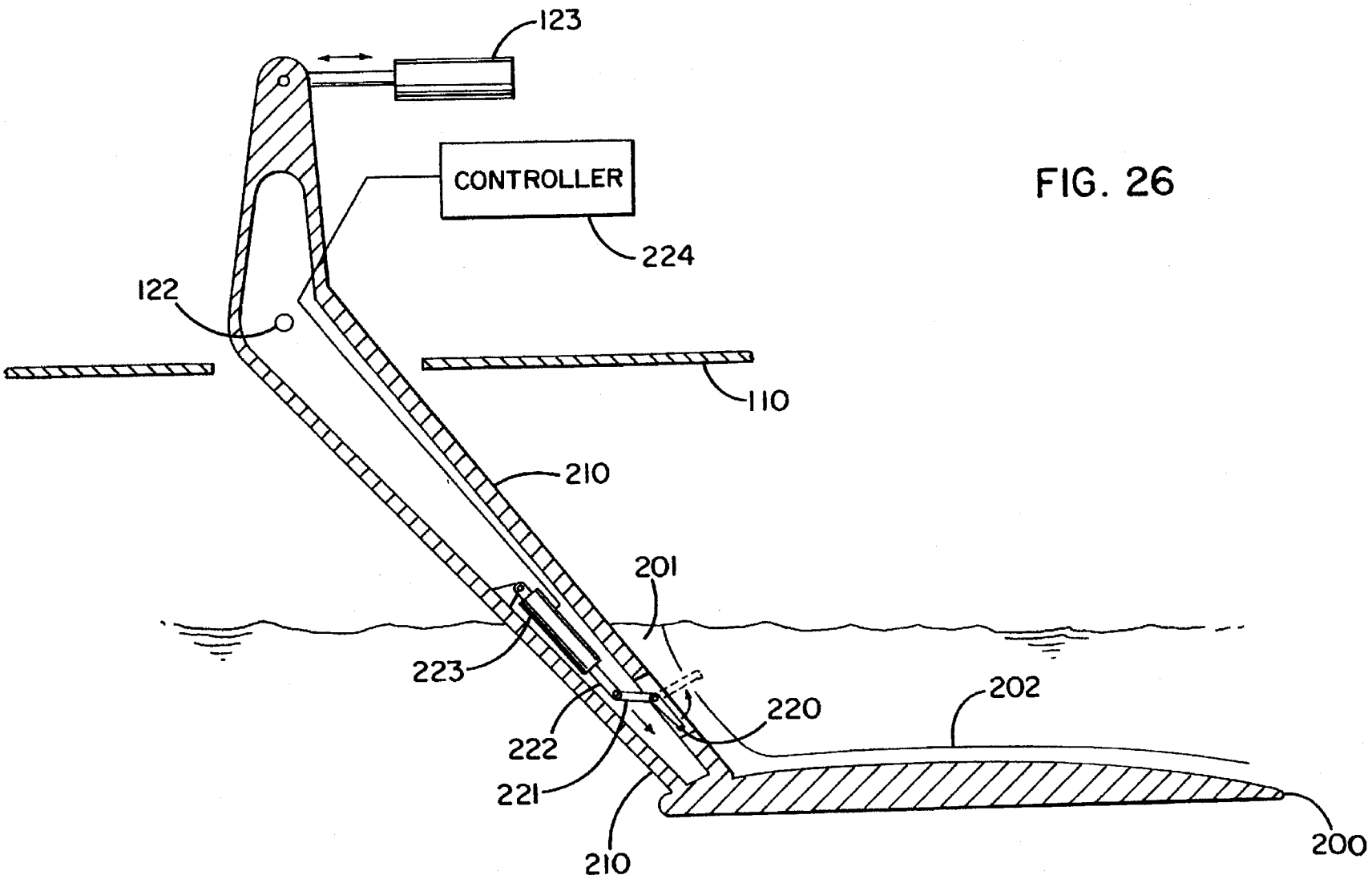
FIG. 26 is a partly cross-sectional schematic side view of a portion of an embodiment having a mechanism for preventing flow of air down a support arm.

Ventilating the upper surface of the foil 200 decreases the lift generated by the foil 200, so at low speeds, such as during take-off (i.e., when the hydrofoil craft has yet to become completely foil-borne), it may be desirable to prevent air from reaching the upper surface of the foil 200 so as to maximize the lift generated by the foil 200 and allow the hydrofoil craft to become foil-borne at as low a speed as possible. If air is supplied to the foil via an internal passage 213 inside of the support arm 210, as in FIG. 24, or via an external conduit 219, as in FIG. 25, the supply of air can be easily stopped by merely closing off the inlet to the passage 213 or conduit 219 by means of valve 216. If air is supplied to the foil 200 along the trailing edge 212 of the support arm 210 rather than internally, a movable baffle or plate can be installed on the support arm 210 to block or permit the flow of air down it. FIG. 26 illustrates an example of such an arrangement. A plate 220 is pivotably mounted on the support arm 210 at a height which is beneath the waterline of the support arm 210 when the hull 110 of the hydrofoil craft is foil-borne. The angle of the plate 220 with respect to the support arm 210 can be controlled by means of a lever 221 connected to the plate 220 and a link 222 extending from the lever 221. By axial movement of the link 222, the plate 220 can be pivoted between a raised position shown by dashed lines and a lowered position shown by solid lines. In the raised position, the plate 220 extends at an angle (such as at right angles) from the trailing edge of the support arm 210 so as to block the flow of air down the support arm 210, and in the lowered position, the plate 220 is at an angle to the trailing edge (such as substantially flush) so as not to impede the flow of air down the support arm 210. The link 222 can be operated by any suitable drive mechanism, such as a motor, a hydraulic or pneumatic actuator, or a hand-operated crank. For example, in FIG. 26, the link 222 is connected to an actuator 223 disposed within the support arm 210. The actuator 223 is controlled by a controller 224 based on the speed of the hydrofoil craft, which can be sensed by a conventional speed sensor connected to the controller 224. Below a prescribed speed of the hydrofoil craft (such as the take-off speed) determined by the weight of the hull 110 and the lift characteristics of the foil 200, the actuator 223 is controlled by the controller 224 so as to maintain the plate 220 in its raised position in which it blocks flow of air down the support arm 210, while above the prescribed speed, the actuator 223 is controlled by the controller 224 to maintain the plate 220 in its lowered position in which it permits flow of air down the support arm 210 to the foil 200. Similarly, in the embodiments of FIGS. 24 and 25, the valves 216 may be automatically controlled by the controller 218 so as to close below a predetermined speed, such as the take-off speed of the hydrofoil craft, and to open above the predetermined speed.

The foil 200 need not have any particular shape, and its profile can be selected in accordance with the desired lift characteristics. For example, the foil 200 may have the shape of a conventional supercavitating foil, and it may be cambered or noncambered. If the leading edge of the lower surface of the foil 200 is at a negative or zero angle to the flow during normal operation, it may be desirable to provide some sort of discontinuity on the foil 200 to force the water above the foil 200 to separate and form a cavity. A simple mechanism for inducing the water flow to separate from the upper surface of the foil 200 is a rigid aft-facing step 203 formed in the upper surface of the foil 200 near its leading edge, as shown in FIG. 22.

The height of the step 203 along its trailing edge is preferably in the range of approximately 1% to approximately 5% of the chord of the foil 200, and the step 203 preferably extends over substantially the entire span of the foil 200. The distance of the trailing edge of the step 203 from the leading edge of the foil 200 is preferably approximately 2% to approximately 20% and more preferably approximately 2% to approximately 5% of the chord.

Figure 27A:
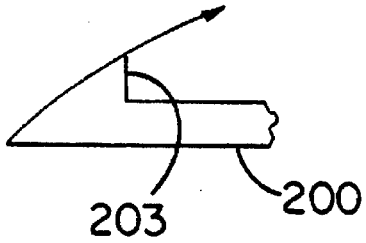
FIGS. 27A–27F are schematic side views showing different types of steps which can be employed with a foil according to the present invention.
Figure 27B:
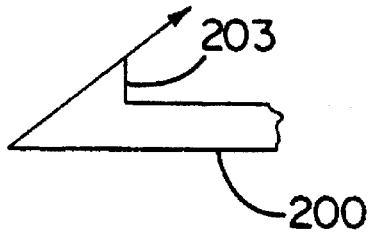
Figure 27C:
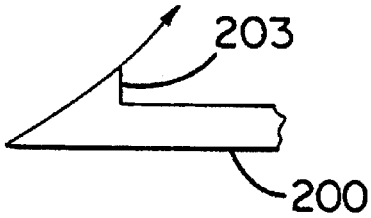
Figure 27D:
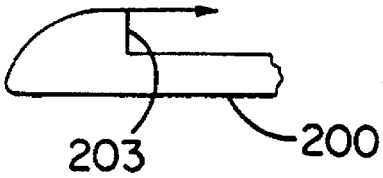
Figure 27E:
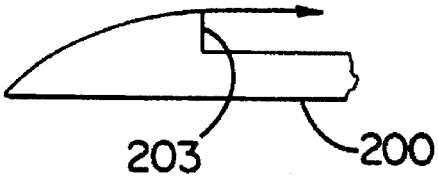
Figure 27F:
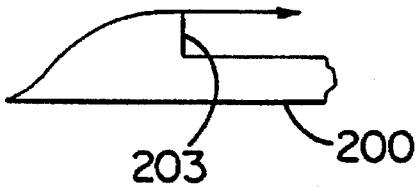

The step 203 can have a variety of shapes. For example, it can be a flow deflecting step which deflects the flow of water upwards and away from the upper surface of the foil 200. FIGS. 27A, 27B, and 27C illustrate three examples of flow deflecting steps, which are respectively a convex step, a straight step having a constant slope, and a concave step. In each of these steps, the upper surface of the step adjoining its trailing edge is sloped upwards with respect to the surface of the foil 200 immediately aft of the step. Alternatively, the step 203 can be a flow lifting step which changes the flow or water to a level above but substantially parallel to the upper surface of the foil 200. FIGS. 27D, 27E, and 27F illustrates flow lifting steps which are respectively a blunt nose step, an ogive step, and a reflex step having a concave shape along its leading edge and then becoming convex further aft. Each of the flow lifting steps has an upper surface adjoining its trailing edge which is substantially parallel to the upper surface of the foil 200 immediately aft of the step 203.

A flow deflecting step can be physically smaller than a flow lifting step for the same height of the air cavity 202 produced, but for a given step height, its drag is substantially greater than that of a flow lifting step. This is primarily because a flow deflecting step develops a substantial negative (downwards) lift and therefore a substantial induced drag.

As long as there is a slope discontinuity at the trailing edge of the step 203, the shape of the portion of the step 203 below the trailing edge is not critical.

Other means can be used to induce flow to separate from the upper surface of the foil 200. For example, a flap having a trailing edge that can be raised and lowered may be pivotably mounted near the leading edge of the foil 200. Alternatively, a spanwise row of holes can be formed in the foil 200 just aft of its leading edge, and compressed air can be directed through the holes to "blow off" the water.

The location relative to the step 203 at which air is supplied to the upper surface of the foil 200 is not critical. Generally, it is preferable if the air is supplied to the foil 200 no further aft than the trailing edge of the step 203. If air is supplied to the upper surface forward of the trailing edge of the step 203, the air can readily flow over the step 203 and into the cavity 202 formed behind the step 203. It is also possible to form a gap in the step 203 through which the air can flow from the upper surface of the step 203 into the cavity 202, but in general this is not necessary. If air is supplied to the foil 200 through an internal passage 213 inside the support arm 210, a convenient location for the outlet 215 of the passage 213 is immediately beneath the trailing edge of the step 203, as shown in FIG. 24. The internal passage 213 may have a plurality of outlets 215 spaced in the spanwise direction of the foil 200, but as the air can readily spread in the spanwise direction, a single outlet 215 will usually be sufficient.

In a hydrofoil craft like that illustrated in FIG. 12 having a main foil and auxiliary foils which are considerably smaller in area than the main foil, the lift coefficient of the auxiliary foils will be much lower than that of the main foil, so until very high speeds (such as 100 knots) are reached, there is no particular need to ventilate the upper surfaces of the auxiliary foils. However, at very high speeds, the auxiliary foils may be ventilated in any of the manners described above with respect to the main foil.

Ventilation of a submerged foil according to the present invention provides a number of significant advantages. First, due to the ventilation, cavitation cannot occur on the upper surface of the foil, so the problems caused by cavitation, such as vibrations and pitting, can be avoided.

Furthermore, ventilation enables efficient operation of a hydrofoil craft according to the present invention. During the operation of a hydrofoil craft having a nonventilated supercavitating foil, the cavity forming above the foil would be filled with water vapor at considerably less than atmospheric pressure (at the vapor pressure of the water surrounding the foil, which may be an extremely low pressure in frigid waters), so the foil would have to be maintained at a high angle of incidence in order to prevent collapse of the cavity. This high angle of incidence would result in an extremely high drag, and this is why supercavitating foils have been found to be impractical. In contrast, the cavity 202 of a ventilated foil 200 according to the present invention is at substantially atmospheric pressure, so the air cavity 202 will not collapse even at an angle of incidence of zero degrees or less. As a result, the foil 200 can be operated at a lower angle of incidence than would be possible for a nonventilated supercavitating foil, resulting in a higher lift/drag ratio and more efficient operation.

In addition, since the ventilated cavity of a hydrofoil craft according to the present invention is less subject to collapse than the low-pressure cavity which would form atop a nonventilated supercavitating foil, the hydrofoil craft can be operated more stably without large fluctuations in lift caused by collapse of the cavity, such as would occur with a nonventilated supercavitating foil.

Accidental ventilation of a submerged foil is a common problem with conventional hydrofoil craft. During operation in rough water, all or a portion of a submerged foil may momentarily broach the water surface. When the foil reenters the water, an air cavity may form atop of the portion of the foil which broached, resulting in a large and sudden decrease in the lift generated by the foil and producing uncomfortable vertical accelerations of the hydrofoil craft. Accidental ventilation can also result in severe rolling problems if only a portion of the upper surface, measured in the spanwise direction, is ventilated due to one wingtip of the foil broaching while the other wingtip is still submerged. Accidental ventilation may occur even without broaching when a portion of a submerged foil comes close to the water surface. However, when the upper surface of a foil is constantly and totally ventilated at its cruising speed according to the present invention, there is no problem of accidental ventilation, and the lift generated by the foil can be maintained substantially constant.

The ability of the foil 200 to be operated at low angles of incidence and a low lift coefficient without collapse of the air-filled cavity 202 is significantly increased if the foil 200 is supported so that its angle of incidence is automatically adjusted in response to upgusts and downgusts in the water surrounding the foil 200, as in any of the preceding embodiments. A downgust acting on a foil with a constant angle of incidence decreases the angle of attack of the foil (the angle of the foil relative to the local flow of water around the foil), and if the angle of attack becomes too small, the air-filled cavity can collapse. However, if the foil is supported such that its angle of incidence increases in response to a downgust, the angle of attack can be maintained substantially constant and the air-filled cavity can be prevented from collapsing. This advantage of a support arm that can automatically adjust the angle of incidence of a foil also applies to a nonventilated supercavitating foil.

Ventilation of the upper surface of a foil can be performed not only with respect to a fully submerged foil, as in the preceding embodiments, but also with respect to a planing foil, i.e., a foil which operates with its lower surface planing atop the water surface in calm water with its upper surface exposed to the atmosphere or only slightly submerged (with the upper surface less than an inch, such as one-tenth of an inch below the surface of the water, for example). When a planing foil encounters a wave, the foil may plunge into the wave and will be submerged until it emerges from the wave. To prevent the submergence of the upper surface of the foil in the wave from producing a sudden change in the lift generated by the foil, a hydrofoil craft with a planing foil may be equipped with an arrangement for ventilating the upper surface of the foil, with air being introduced through or along the support arm, as in the embodiments of FIGS. 22–27, for example.

What is claimed is:

1. A hydrofoil craft comprising:

a hull;

a foil for supporting the hull above a water surface;

a support arm connected between the hull and the foil, an angle of the support arm with respect to a horizontal plane being at most approximately 60 degrees; and gas supplying means for supplying gas to a submerged upper surface of the foil to form a gas-filled cavity on the upper surface having a pressure between approximately 80% and approximately 100% of atmospheric pressure.

2. A hydrofoil craft according to claim 1 wherein the gas-filled cavity has a pressure of approximately at least 90% of atmospheric pressure.

3. A hydrofoil craft according to claim 1 wherein the gas-filled cavity has a pressure of approximately at least 94% of atmospheric pressure.

4. A hydrofoil craft according to claim 1 wherein the gas supplying means comprises a passage within the support arm communicating between the atmosphere and the upper surface of the foil.

5. A hydrofoil craft according to claim 1 wherein the gas supplying means comprises a conduit mounted on an exterior of the support arm and communicating between the atmosphere and the upper surface of the foil.

6. A hydrofoil craft according to claim 1 wherein the support arm is pivotally connected to the hull in a manner permitting the foil to move with respect to the hull in concert with upward and downward water forces acting on the foil.

7. A hydrofoil craft according to claim 1 wherein the angle is approximately 30 to approximately 50 degrees.

8. A hydrofoil craft according to claim 1 wherein the gas supplying means comprises a trailing edge of the support arm shaped to guide atmospheric air down the support arm to the upper surface of the foil.

9. A hydrofoil craft according to claim 8 wherein the support arm has a streamlined leading edge and a blunt trailing edge providing an unimpeded flow path for air between the atmosphere and the upper surface of the foil.

10. A hydrofoil craft according to claim 8 wherein the trailing edge is planar.

11. A hydrofoil craft according to claim 8 wherein an outer surface of the support arm has a discontinuity adjoining the trailing edge to produce flow separation from the support arm.

12. A hydrofoil craft according to claim 8 wherein the trailing edge of the support arm at the upper surface of the foil is spaced from a leading edge of the foil by at most 20% of a chord of the foil.

13. A hydrofoil craft according to claim 12 wherein the trailing edge of the support arm at the upper surface of the foil is spaced from the leading edge of the foil by at most 5% of the chord of the foil.

14. A hydrofoil craft according to claim 12 wherein the upper surface of the foil has a discontinuity formed therein for producing flow separation from the upper surface, the trailing edge of the support arm joining the upper surface of the foil no further from a leading edge of the foil than the discontinuity.

15. A hydrofoil craft according to claim 14 wherein the discontinuity comprises a step formed in the upper surface.

16. A hydrofoil craft comprising:

a hull;

a foil for supporting the hull above a water surface;

a support arm connected between the hull and the foil; and gas supplying means for supplying gas to a submerged upper surface of the foil to form a gas-filled cavity on the upper surface having a pressure between approximately 80% and approximately 100% of atmospheric pressure, the gas supplying means comprising a passage within the support arm communicating between the atmosphere and the upper surface of the foil and means for adjusting flow of air through the passage in accordance with speed of the hydrofoil craft.

17. A hydrofoil craft comprising:

a hull;

a foil for supporting the hull above a water surface;

a support arm connected between the hull and the foil and having a streamlined leading edge;

gas supplying means for supplying gas to a submerged upper surface of the foil to form a gas-filled cavity on the upper surface having a pressure between approximately 80% and approximately 100% of atmospheric pressure, the gas supplying means comprising a blunt trailing edge of the support arm providing an unimpeded flow path for air between the atmosphere and the upper surface of the foil; and blocking means for selectively blocking flow of air down the flow path.

18. A hydrofoil craft according to claim 17 wherein the blocking means comprises a plate movably mounted on the support arm and movable between positions in which it blocks or allows flow down the flow path.

19. A hydrofoil craft according to claim 17 wherein the blocking means is responsive to a speed of the hydrofoil craft and blocks flow of air down the flow path below a predetermined speed and permits flow of air above the predetermined speed.

20. A hydrofoil craft comprising:

a hull;

a foil for supporting the hull above a water surface;

a support arm connected between the hull and the foil and having a trailing edge; and a flow preventing member mounted on the support arm below the water surface and selectively permitting and preventing air flow down the trailing edge of the support arm from the water surface to the foil.

21. A hydrofoil craft according to claim 20 including a controller for controlling the flow preventing member in accordance with a speed of the hydrofoil craft.

22. A hydrofoil craft as claimed in claim 21 wherein the controller prevents air flow down the trailing edge below a predetermined speed of the hydrofoil craft and permits flow above the predetermined speed.

23. A hydrofoil craft as claimed in claim 20 wherein an angle of the support arm with respect to a horizontal plane is at most approximately 60 degrees.

24. A method of operating a hydrofoil craft comprising:

supporting a hull of a hydrofoil craft above a water surface by means of a foil;

introducing atmospheric air down a support arm extending between the hull and the foil to a submerged upper surface of the foil to form an air-filled cavity on the upper surface having a pressure between approximately 80% and approximately 100% of atmospheric pressure; and disposing the support arm at an angle of at most approximately 60 degrees with respect to a horizontal plane while introducing atmospheric air down the support arm.

25. A method according to claim 24 including allowing the support arm to pivot about an axis extending in a transverse direction of the hull to enable the foil to move with respect to the hull in concert with water forces acting on the foil.

26. A method of operating a hydrofoil craft comprising:

supporting a hull of a hydrofoil craft above a water surface by means of a foil;

introducing atmospheric air down a support arm extending between the hull and the foil to a submerged upper surface of the foil to form an air-filled cavity on the upper surface having a pressure between approximately 80% and approximately 100% of atmospheric pressure; and preventing flow of air down the support arm when the speed of the hydrofoil craft is below a predetermined value and permitting flow of air down the support arm when the speed is above the predetermined value.

27. A hydrofoil craft comprising:

a hull;

a foil for supporting the hull above a water surface;

a support arm connected between the hull and the foil, an upper end of the support arm being pivotally connected to the hull in a manner permitting the foil to move with respect to the hull in concert with upward and downward water forces acting on the foil, an angle of the support arm with respect to a horizontal plane being at most approximately 60 degrees, the support arm having a streamlined leading edge and a trailing edge shaped to guide atmospheric air along the trailing edge to an upper surface of the foil to form a gas-filled cavity on the upper surface.

28. A hydrofoil craft according to claim 27 wherein the trailing edge of the support arm at the upper surface of the foil is spaced from a leading edge of the foil by at most 20% of a chord of the foil.

* * * * *